US011198575B2

(12) United States Patent
Iwasaki

(10) Patent No.: US 11,198,575 B2
(45) Date of Patent: Dec. 14, 2021

(54) IMAGE FORMING DEVICE THAT DETERMINES WHETHER A RECORDING MATERIAL IS IN A SKEWED STATE

(71) Applicant: CANON KABUSHIKI KAISHA, Tokyo (JP)

(72) Inventor: Atsushi Iwasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/882,988

(22) Filed: May 26, 2020

(65) Prior Publication Data

US 2020/0377318 A1 Dec. 3, 2020

(30) Foreign Application Priority Data

May 27, 2019 (JP) ..... JP2019-098502

(51) Int. Cl.

| | |
|---|---|
| ***G03G 15/20*** | (2006.01) |
| ***B65H 7/06*** | (2006.01) |
| ***G03G 15/00*** | (2006.01) |
| ***B41J 11/00*** | (2006.01) |

(52) U.S. Cl.

CPC ..... *B65H 7/06* (2013.01); *B41J 11/0095* (2013.01); *G03G 15/2039* (2013.01); *G03G 15/2064* (2013.01); *G03G 15/55* (2013.01); *B65H 2511/242* (2013.01); *B65H 2801/03* (2013.01); *G03G 2215/00721* (2013.01); *G03G 2215/2035* (2013.01)

(58) Field of Classification Search

USPC ..... 399/394

See application file for complete search history.

(56) References Cited

U.S. PATENT DOCUMENTS

| | | | | |
|---|---|---|---|---|
| 9,977,387 | B2 | 5/2018 | Shida et al. | |
| 10,459,379 | B2 | 10/2019 | Shimura | |
| 2016/0223974 | A1* | 8/2016 | Shida | G03G 15/55 |
| 2017/0102650 | A1* | 4/2017 | Shimura | H05B 3/03 |

(Continued)

FOREIGN PATENT DOCUMENTS

| | | | |
|---|---|---|---|
| JP | 06110561 | A * | 4/1994 |
| JP | 2014059508 | A | 4/2014 |
| JP | 2015184422 | A | 10/2015 |

(Continued)

*Primary Examiner* — Q Grainger

(74) *Attorney, Agent, or Firm* — Venable LLP

(57) ABSTRACT

Provided is an image forming device including: an image heating portion which includes a heater including a plurality of heating blocks divided in a direction orthogonal to a conveying direction of a recording material and heats an image formed on the recording material; a temperature sensing element which senses a temperature of each of the heating blocks; and a control portion which controls electric power supplied to each of the heating blocks on the basis of the temperature sensed by the temperature sensing element, wherein the control portion determines whether or not the recording material is in a skewed state in which the recording material is conveyed in an obliquely inclined state with respect to the conveying direction on the basis of a variation of the electric power supplied to end heating blocks for heating end portions of the recording material among the plurality of the heating blocks.

15 Claims, 16 Drawing Sheets

(56) References Cited

U.S. PATENT DOCUMENTS

| | | | | |
|---|---|---|---|---|
| 2018/0335731 | A1* | 11/2018 | Ogura | G03G 15/5004 |
| 2020/0026227 | A1 | 1/2020 | Iwasaki | |

FOREIGN PATENT DOCUMENTS

| | | | |
|---|---|---|---|
| JP | 2016139075 | A | 8/2016 |
| JP | 2017142437 | A | 8/2017 |
| JP | 2019032356 | A | 2/2019 |

* cited by examiner

IMAGE FORMING DEVICE THAT DETERMINES WHETHER A RECORDING MATERIAL IS IN A SKEWED STATE

BACKGROUND OF THE INVENTION

Field of the Invention

The present invention relates to an image forming device including an image heating device such as a fixing device that thermally fixes an unfixed toner image formed on a recording material such as paper, or a gloss imparting device that improves glossiness of a toner image by reheating a fixed toner image on a recording material.

Description of the Related Art

In conventional image forming devices of this type, a recording material on which an unfixed toner image is formed is passed through a fixing nip portion of an image heating device to apply heat and pressure to the toner image, thereby heating and fixing the toner image on the recording material. The recording material is fed from a cassette or a tray, the unfixed toner image is printed on the recording material, and then the recording material is conveyed to the image heating device. Here, if the recording material is not set properly, the recording material may be conveyed in a state in which longitudinal and lateral directions of the recording material are inclined (skewed) with respect to a conveying direction thereof, which may cause deterioration of printing accuracy or a jam. As a method of detecting the skewing of a recording material, an image forming device as disclosed in Japanese Patent Application Publication No. 2016-139075 is proposed. Japanese Patent Application Publication No. 2016-139075 discloses a method of detecting a conveyance abnormality such as skewing of a recording material when a temperature difference between both ends satisfies a predetermined condition by utilizing temperature sensing units provided near both ends of the recording material in a direction orthogonal to a conveying direction of the recording material.

On the other hand, an image forming device generally supports recording materials of various sizes. For example, in the case of an image forming device in which a maximum width of a recording material on which an image can be formed is the LETTER vertical size (216 mm), it also supports narrower sizes such as an A4 vertical size, a B5 vertical size, an A5 vertical size, and a postcard size (small size paper). In addition, an image heating device as disclosed in Japanese Patent Application Publication No. 2014-59508 is proposed as a method of inhibiting a phenomenon in which a temperature of a region through which paper does not pass in a fixing nip portion gradually rises (a temperature rise in a non-paper passing portion) when the recording materials of various sizes as described above are passed therethrough. Japanese Patent Application Publication No. 2014-59508 proposes a device in which a heating element on a heater is divided into a plurality of groups (heating blocks) in a direction orthogonal to a conveying direction of a recording material (a heater longitudinal direction), and a heat generation distribution of the heater is switched in accordance with a size of the recording material. A temperature sensing member for detecting a temperature of each of the heating blocks is disposed in the plurality of the divided heating blocks, thereby controlling a heat generation amount on the basis of detection results thereof.

SUMMARY OF THE INVENTION

Japanese Patent Application Publication No. 2016-139075 discloses that, with respect to a heating element formed in a longitudinal direction of a heater, a central thermistor positioned at a center in the longitudinal direction controls a temperature of a paper passing region, and distal thermistors positioned at both end portions in the longitudinal direction monitor changes in temperature of the end portions. However, since a temperature change amount or a temperature difference between left and right sides in the case of skewing is small, there have been cases in which, depending on temperature sensing accuracy on the left and right sides, determination of skewing is not possible unless a large difference in temperature between the left and right sides occurs.

An object of the present invention is to propose a technique with which a conveyance state of a recording material is detected accurately, thereby improving usability.

In order to achieve the above object, an image forming device of the present invention includes:

an image forming portion which forms an image on a recording material;

an image heating portion which includes a heater including a plurality of heating blocks divided in a direction orthogonal to a conveying direction of the recording material and heats the image formed on the recording material;

a temperature sensing element which senses a temperature of each of the heating blocks; and a control portion which controls electric power supplied to each of the heating blocks on the basis of the temperature sensed by the temperature sensing element;

wherein the control portion determines whether or not the recording material is in a skewed state in which the recording material is conveyed in an obliquely inclined state with respect to the conveying direction on the basis of a variation of the electric power supplied to end heating blocks for heating end portions of the recording material among the plurality of the heating blocks.

According to the present invention, it is possible to provide an image forming device in which skewing of the recording material is accurately detected, and high usability is provided.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1:
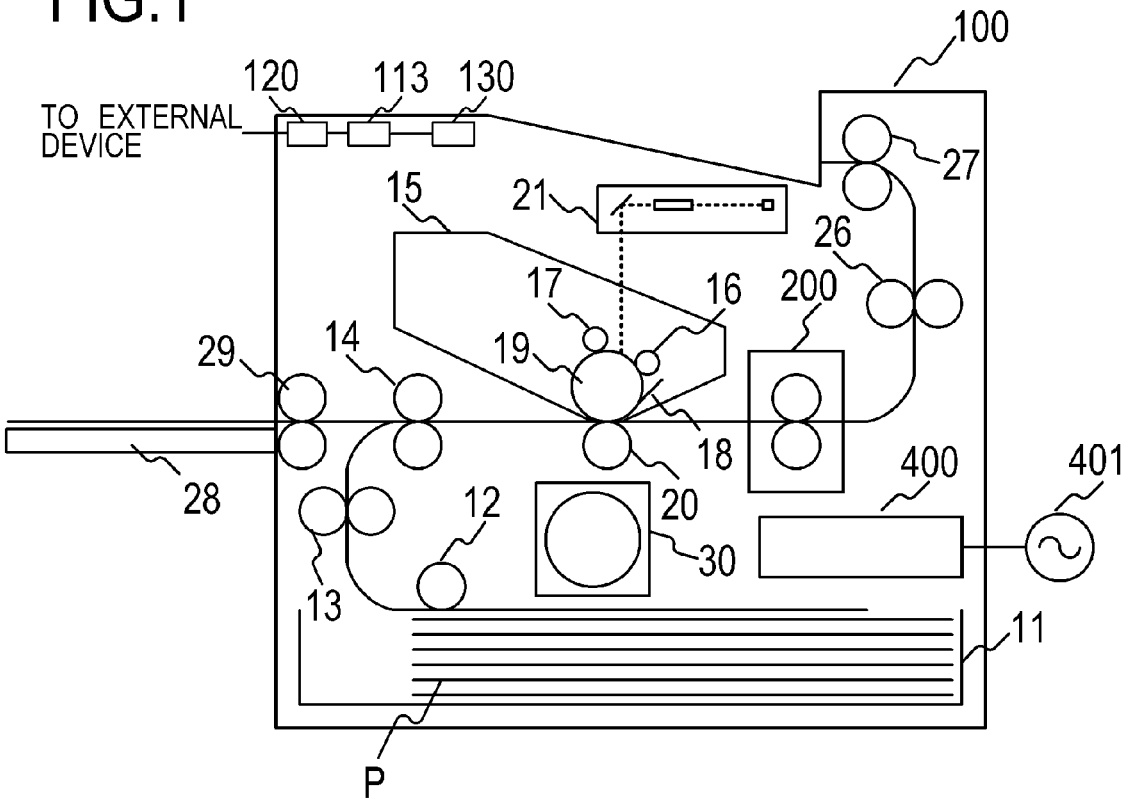
FIG. 1 is a cross-sectional view of an image forming device.

FIG. 1 is a schematic cross-sectional view of an image forming device according to an embodiment of the present invention. As the image forming device to which the present invention is applicable, a copying machine, a printer and the like using an electrophotographic system or an electrostatic recording system may be exemplified, and here, a case in which the present invention is applied to a laser printer that forms an image on a recording material P using an electrophotographic system will be described.

The image forming device 100 includes a video controller 120 and a control portion 113. The video controller 120 serves as an acquisition portion that acquires information on an image formed on a recording material and information on a size, a type, and the like of the recording material on which the image is formed, and receives and processes image information and print instructions transmitted from an external device such as a personal computer. Also, the image forming device 100 includes an operation panel 130, and various information and print instructions may be transmitted to the control portion 113 in accordance with an input from the operation panel 130 operated by a user (operator). The control portion 113 is connected to the video controller 120 and controls each portion constituting the image forming device 100 in response to an instruction from the video controller 120. When the video controller 120 receives a print instruction from an external device, image formation is performed through the following operations.

When a print signal is generated, a scanner unit 21 emits laser light modulated in accordance with image information to scan a photosensitive body (a photosensitive drum) 19 charged to a predetermined polarity by a charging roller 16. Thus, an electrostatic latent image is formed on the photosensitive body 19. Toner is supplied from a developer (a developing roller) 17 to the electrostatic latent image, and a toner image corresponding to the image information is formed on the photosensitive body 19 serving as an image carrier. On the other hand, the recording material (recording paper) P stacked in a paper feeding cassette (a paper feeding portion) 11 is fed one by one by a pickup roller 12 and conveyed by a pair of rollers 13 toward a pair of resist rollers 14. Further, the recording material P is conveyed from the pair of resist rollers 14 to a transfer position at a timing when the toner image on the photosensitive body 19 reaches the transfer position formed by the photosensitive body 19 and a transfer roller 20. The toner image on the photosensitive body 19 is transferred to the recording material P while the recording material P passes through the transfer position. Thereafter, the recording material P is heated by a fixing device (an image heating device) 200 serving as a fixing portion (an image heating portion), and the toner image is heated and fixed on the recording material P. The recording material P carrying the fixed toner image is discharged to a tray located at an upper portion of the image forming device 100 by a pair of conveyance rollers 26 and 27.

A drum cleaner 18 cleans the toner remaining on the photosensitive body 19. A paper feed tray (a manual feed tray) 28 having a pair of recording material regulation plates having an adjustable width in accordance with a size of the recording material P is provided to support recording materials P other than those having a standard size. A pickup roller 29 feeds the recording material P from the paper feed tray 28. The image forming device 100 includes a motor 30 that drives the fixing device 200 and the like. A control circuit 400 serving as a heater driving unit connected to a commercial AC power source 401 controls electric power supply to the fixing device 200.

The photosensitive body 19, the charging roller 16, the scanner unit 21, the developer 17, and the transfer roller 20 described above constitute an image forming portion that forms an unfixed image on the recording material P. Also, in the present embodiment, the photosensitive body 19, the charging roller 16, a developing unit including the developer 17, and a cleaning unit including the drum cleaner 18 are integrated as a process cartridge 15 and configured to be attachable to and detachable from a main body of the image forming device 100.

The image forming device 100 of the present embodiment supports a plurality of recording material sizes. LETTER paper (216 mm×279 mm), A4 paper (210 mm×297 mm), B5 paper (182 mm×257 mm), A5 paper (148 mm×210 mm), or the like can be set in the paper feed cassette 11.

The printer of the present embodiment is basically a laser printer that longitudinally feeds paper (conveys paper such that long sides of the paper are parallel to a conveying direction). Further, the present invention can also be applied to a printer that laterally feeds paper. In addition, the largest (largest in width) recording material among standard recording material widths (recording material widths on catalogs) supported by the device is LETTER paper, and the width thereof is 216 mm.

Figure 2:
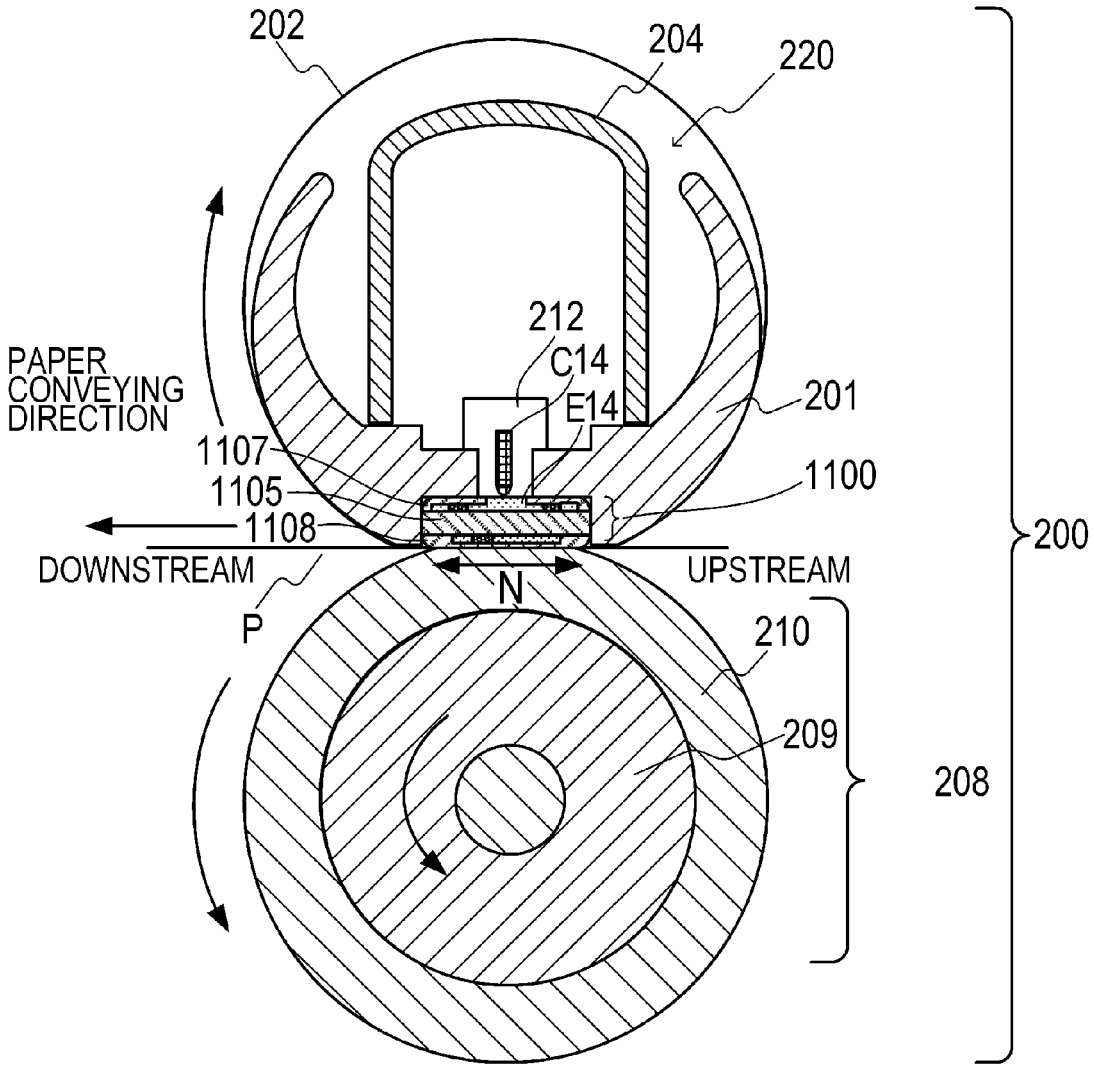
FIG. 2 is a cross-sectional view of a fixing device.

FIG. 2 is a schematic cross-sectional view of the fixing device 200 that is an example of the image heating device of the present embodiment. The fixing device 200 has a tubular film 202 that is a heating rotating body, a heating unit 220 that comes into contact with an inner surface of the film 202, and a pressure roller (a pressure rotating body) 208 serving as a pressure member that comes into contact with an outer surface of the film 202. The heating unit 220 includes a heater 1100, a holding member 201, and a metal stay 204. The pressure roller 208 forms a fixing nip portion N together with the heater 1100 with the film 202 interposed therebetween.

The film 202 is a multi-layer heat-resistant film having a flexible tubular shape, and a base layer thereof is made of a heat-resistant resin such as a polyimide or a metal such as stainless steel. Further, the film 202 may be provided with an elastic layer such as a heat resistant rubber or a release layer made of a heat resistant resin.

The pressure roller 208 has a core metal 209 made of a material such as iron or aluminum, and an elastic layer 210 made of a material such as silicone rubber. The heater 1100 is held by the holding member 201 made of a heat resistant resin such as liquid crystal polymer. The holding member 201 also has a guide function of guiding rotation of the film 202.

Viscous grease (not shown) is applied to sliding portions of the film 202, the heater 1100, and the holding member 201. This grease is a mixture of fluorine resin and fluorine oil, and has a role of reducing a sliding resistance between the film 202 and the heater 1100 and the holding member 201. A viscosity of grease has a correlation with temperature in which the viscosity decreases and a sliding property increases as the temperature becomes higher. The pressure roller 208 receives power from the motor 30 and rotates in a direction indicated by an arrow. As the pressure roller 208 rotates, the film 202 is driven and rotated. The recording material P carrying the unfixed toner image is heated while being nipped and conveyed by the fixing nip portion N and is subjected to a fixing process. As described above, the fixing device 200 includes the tubular film 202 and the heating unit 220 that includes the heater 1100 and comes into contact with the inner surface of the film 202, and heats the image formed on the recording material with heat from the heater 1100 via the film 202.

Figure 3A:
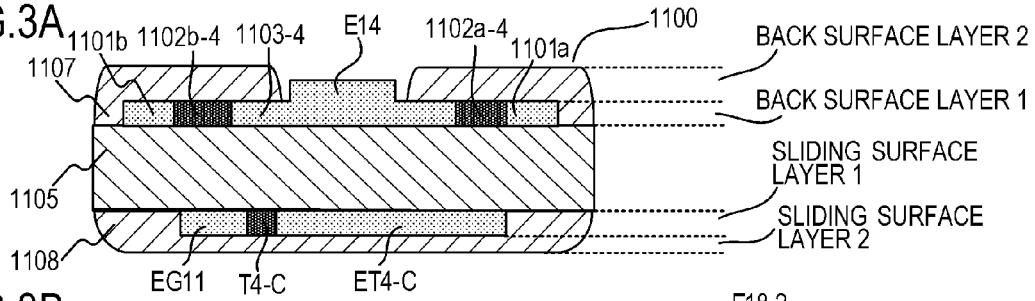
FIG. 3A to FIG. 3C are configuration diagrams of a heater.
Figure 3B:
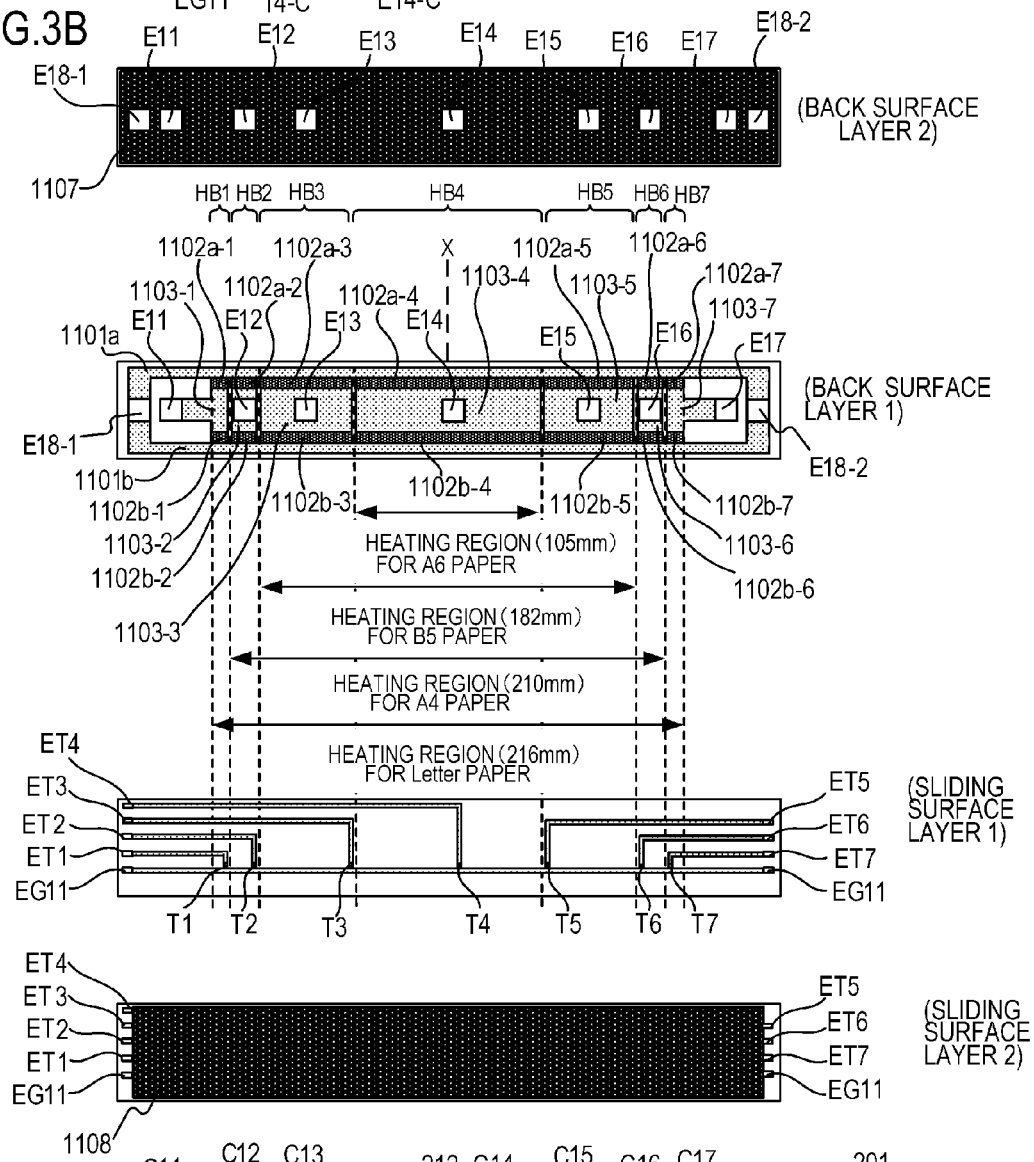
Figure 3C:
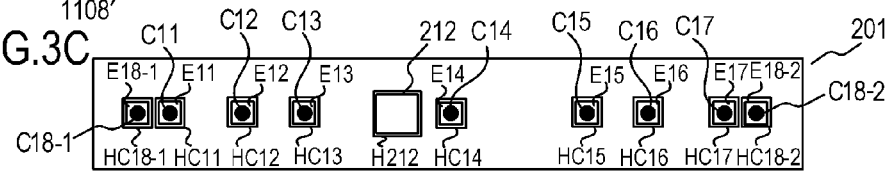

The heater 1100 has a ceramic substrate 1105 and a heating resistor (heating element) which is provided on the substrate 1105 and supplied with electric power to generate heat (see FIG. 3A to FIG. 3C). A surface protection layer 1108 made of glass is provided on a surface of the substrate 1105 on a fixing nip portion N side in order to secure a sliding property of the film 202. A surface protection layer 1107 made of glass is provided on a surface of the substrate 1105 opposite to the surface on the fixing nip portion N side in order to insulate the heating resistor. Electrodes (here, E14 is shown as a representative) are exposed on the second surface, and the heating resistor is electrically connected to the AC power source 401 by bringing the electrodes into contact with electric contact points for electric power supply (here, C14 is shown as a representative). Also, details of the heater 1100 will be described later.

A protection element 212 such as a thermoswitch or a thermal fuse that is operated due to abnormal heat generation of the heater 1100 to shut off electric power supplied to the heater 1100 is disposed to abut the heater 1100 or have a slight gap with the heater 1100. The metal stay 204 is for applying pressure of a spring (not shown) to the holding member 201, and also has a role of reinforcing the holding member 201 and the heater 1100.

FIG. 3A and FIG. 3B show configuration diagrams of the heater 1100 of the first embodiment. FIG. 3A shows a cross-sectional view of the heater 1100 near a conveyance reference position X of the recording material P shown in FIG. 3B. FIG. 3B shows a plan view of each layer of the heater 1100. FIG. 3C is a plan view of the holding member that holds the heater 1100.

The image forming device 100 of the present embodiment is a center-referenced printer that conveys a recording material by aligning a center of the recording material in a width direction thereof (a direction orthogonal to a conveying direction) with the conveyance reference position X.

The heater 1100 is configured of the ceramic substrate 1105, a back surface layer 1 provided on the substrate 1105, a back surface layer 2 covering the back surface layer 1, a sliding surface layer 1 provided on a surface of the substrate 1105 opposite to the back surface layer 1, and a sliding surface layer 2 covering the sliding surface layer 1.

A plurality of heating blocks each including a set of a first conductor 1101, a second conductor 1103, and a heating resistor (a heating element) 1102 are provided on the back surface layer 1 of the heater 1100, which is a heater surface opposite to a heater surface that comes into contact with the film 202, in a longitudinal direction of the heater 1100. The heater 1100 of the present embodiment has a total of seven heating blocks HB1 to HB7. Independent control for the heating blocks will be described later.

Each heating block has the first conductor 1101 provided in a longitudinal direction of the substrate, the second conductor 1103 provided in the longitudinal direction of the substrate at a position different from the first conductor 1101 in a lateral direction (a direction orthogonal to the longitudinal direction) of the substrate. Further, each heating block has the heating resistor 1102 which is provided between the first conductor 1101 and the second conductor 1103 and generates heat due to energization provided through the first conductor 1101 and the second conductor 1103.

The heating resistor 1102 of each heating block is divided into a heating resistor 1102*a* and a heating resistor 1102*b* which are formed at symmetrical positions with respect to a center of the substrate in a lateral direction of the heater 1100. Also, the first conductor 1101 is divided into a conductor 1101*a* connected to the heating resistor 1102*a* and a conductor 1101*b* connected to the heating resistor 1102*b*. The heating resistor 1102*a* and the heating resistor 1102*b* are formed at symmetrical positions with respect to the center of the substrate.

Since the heater 1100 has seven heating blocks HB1 to HB7, the heating resistor 1102*a* is divided into seven parts 1102*a*-1 to 1102*a*-7. Similarly, the heating resistor 1102*b* is divided into seven parts 1102*b*-1 to 1102*b*-7. Further, the second conductor 1103 is also divided into seven parts 1103-1 to 1103-7. In addition, the heating resistors 1102*a*-1 to 1102*a*-7 are disposed in the substrate 1105 on an upstream side in the conveying direction of the recording material P, and the heating resistors 1102*b*-1 to 1102*b*-7 are disposed in the substrate 1105 on a downstream side in the conveying direction of the recording material P.

The back surface layer 2 of the heater 1100 is provided with the insulating (glass in the present embodiment) surface protection layer 1107 that covers the heating resistor 1102, the first conductor 1101, and the second conductor 1103. However, the surface protection layer 1107 does not cover electrode parts E11 to E17, E18-1 and E18-2 which come into contact with electrical contact points C11 to C17, C18-1 and C18-2 for supplying electric power. The electrode parts E11 to E17 are electrodes for supplying electric power to the heating blocks HB1 to HB7 via the second conductors 1103-1 to 1103-7, respectively. The electrodes E18-1 and E18-2 are electrodes for supplying electric power to the heating blocks HB1 to HB7 via the first conductors 1101*a* and 1101*b*.

Incidentally, since resistance values of the conductors are not zero, they have an influence on a heat generation distribution in the longitudinal direction of the heater 1100. Therefore, the electrodes E18-1 and E18-2 are separately provided at both ends in the longitudinal direction of the heater 1100 so that the heat generation distribution does not become uneven even if affected by the electric resistance of the first conductors 1101*a* and 1101*b* and the second conductors 1103-1 to 1103-7.

As shown in FIG. 2, the protection element 212 and the electrical contact points C11 to C17, C18-1, and C18-2 are provided in a space between the stay 204 and the holding member 201. As shown in FIG. 3C, the holding member 201 is provided with holes HC11 to HC17, HC18-1 and HC18-2 through which the electrical contact points C11 to C17, C18-1 and C18-2 connected to the electrodes E11-E17, E18-1, and E18-2 are passed. In addition, the holding member 201 is also provided with a hole H212 through which a heat-sensitive part of the protection element 212 passes. The electrical contact points C11 to C17, C18-1, and C18-2 are electrically connected to the corresponding electrodes using a method such as biasing by a spring or welding. The protection element 212 is also biased by a spring, and the heat-sensitive portion comes into contact with the surface protection layer 1107. Each electrical contact point is connected to the control circuit of the heater 1100 via a conductive member such as a cable or a thin metal plate provided in the space between the stay 204 and the holding member 201.

By providing the electrodes on the back surface of the heater 1100, it is not necessary to provide a region for disposing wiring electrically connected to each of the second conductors 1103-1 to 1103-7 on the substrate 1105, and thus a width of the substrate 1105 in the lateral direction can be reduced. Therefore, an increase in size of the heater can be inhibited. Further, as shown in FIG. 3B, the electrodes E12 to E16 are provided in regions in which the heating resistors are provided in the longitudinal direction of the substrate.

As will be described later, the heater 1100 of the present embodiment is able to form various heat generation distributions by independently controlling a plurality of heating blocks. For example, the heat generation distribution can be set in accordance with the size of the recording material. Further, the heating resistor 1102 is formed of a material having a positive temperature coefficient (PTC). By using the material having a PTC, it is possible to inhibit a temperature rise of a non-paper passing portion even in the case in which an edge of the recording material does not coincide with boundaries of the heating blocks.

Thermistors T1 to T7 which are temperature sensing elements (temperature sensing units) for detecting temperatures of the respective heating blocks HB1 to HB7 are formed in the sliding surface layer 1 of the heater 1100 on a sliding surface (a surface contacting the film) side thereof. A material of the thermistors may be a material whose temperature coefficient of resistance (TCR) is positively or negatively large. In the present embodiment, a material having a negative temperature coefficient (NTC) is thinly printed on the substrate to form the thermistors which are the temperature sensing units. The thermistors are used to control the film to be a target temperature.

An arrangement of the thermistor for each heating block will be described.

As shown in FIG. 3B, one thermistor is disposed for one heating block. For example, the thermistor T5 is provided for the heating block HB5, and a conductive pattern ET5 for detecting the resistance value and a common conductive pattern EG11 form a structure with which the temperature can be detected.

In the configuration of the present embodiment, the thermistor disposed in each heating block is disposed at an end portion on a side close to a paper passing reference such that the width of the recording material is within a paper passing region whenever possible even if the width of the recording material changes. A longitudinal position of the thermistor is not limited to that of the present embodiment. For example, it may be configured to be disposed at a longitudinal center of each heating block.

The insulating (glass in the present embodiment) surface protection layer 1108 is formed by being coated on the surface (sliding surface layer 2) of the substrate 1105 on the fixing nip portion N side in order to secure a sliding property of the film 202. The surface protection layer 1108 covers the thermistor, the conductive pattern, and the common conductive pattern. However, in order to secure connection with the electrical contact points, as shown in FIG. 3B, a portion of the conductive pattern and a portion of the common conductive pattern are exposed at both ends of the heater 1100.

Figure 4:
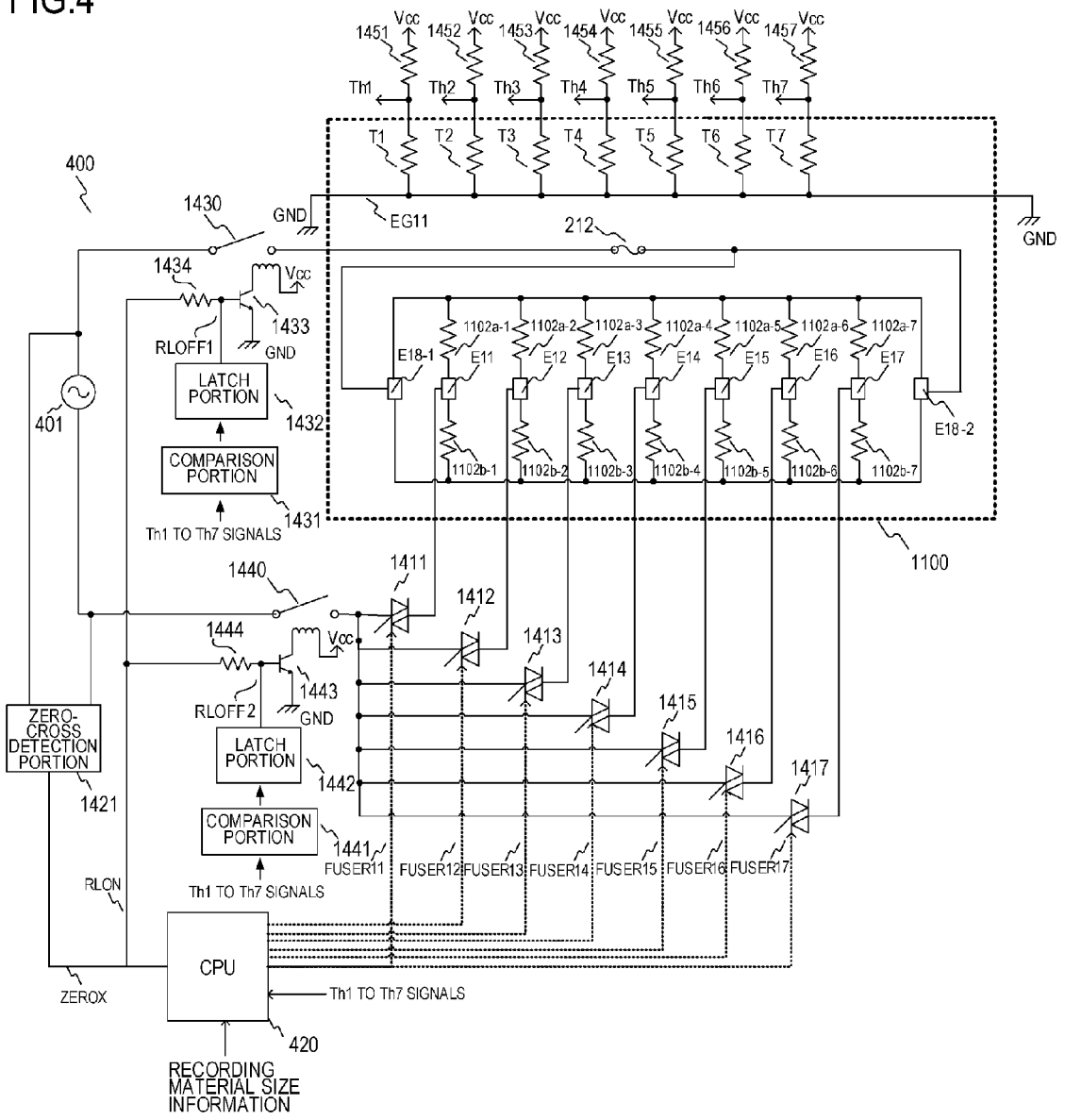
FIG. 4 is a control circuit diagram of the heater.

FIG. 4 is a circuit diagram of the control circuit 400 which is a control unit of the heater 1100. Electric power control of the heater 1100 is performed by turning on and off triacs 1411 to 1417. The triacs 1411 to 1417 are respectively operated in accordance with FUSER11 to FUSER17 signals from a CPU 420 serving as a control portion.

The control circuit 400 of the heater 1100 has a circuit configuration capable of independently controlling the seven heating blocks HB11 to HB17 using the seven triacs 1411 to 1417. Also, in FIG. 4, drive circuits for the triacs 1411 to 1417 are omitted.

A zero-cross detection portion 1421 is a circuit that detects a zero-cross of the AC power source 401, and outputs a ZEROX signal to the CPU 420. The ZEROX signal is used as a reference signal for controlling phases of the triacs 1411 to 1417.

Next, a method for detecting the temperature of the heater 1100 will be described. Detection of the temperature of the heater 1100 is performed by the thermistors T1 to T7. Signals (Th1 to Th7) obtained by dividing a voltage Vcc using resistance values of the thermistors T1 to T7 and resistance values of resistors 1451 to 1457 are input to the CPU 420. For example, the signal Th4 is a signal obtained by dividing the voltage Vcc using the resistance value of the thermistor T4 and the resistance value of the resistor 1454. The thermistor T4 has a resistance value in accordance with a temperature, and thus, when the temperature of the heating block HB14 changes, a level of the signal Th4 input to the CPU also changes. The CPU 420 converts each input signal into a temperature corresponding to the level.

The CPU 420 calculates the supplied electric power, for example, using PI control on the basis of a set temperature (a control target temperature) of each heating block and a detected temperature of each thermistor. Further, the calculated supplied electric power is converted into a control timing such as a corresponding phase angle (phase control) and a wave number (wave number control), and the triacs 1411 to 1417 are controlled at this control timing. Since processing of signals corresponding to other thermistors is similar, the description thereof will be omitted.

A relay 1430 and a relay 1440 are mounted as means for shutting off electric power to the heater 1100 when the heater 1100 is overheated due to a device failure or the like.

Circuit operations of the relay 1430 and the relay 1440 will be described. When a RLON signal output from the CPU 420 becomes a high state, a transistor 1433 is turned on, a secondary side coil of the relay 1430 is energized by a DC power source (voltage Vcc), and a primary side contact point of the relay 1430 is turned on. When the RLON signal becomes a low state, the transistor 1433 is turned off, a current flowing from the power source (voltage Vcc) to the secondary side coil of the relay 1430 is cut off, and the primary side contact point of the relay 1430 is turned off. Similarly, when the RLON signal becomes the high state, a transistor 1443 is turned on, a secondary side coil of the relay 1440 is energized by the power source (voltage Vcc), and a primary side contact point of the relay 1440 is turned on. When the RLON signal becomes the low state, the transistor 1443 is turned off, a current flowing from the power source (voltage Vcc) to the secondary side coil of the relay 1440 is cut off, and the primary side contact point of the relay 1440 is turned off. Also, the resistors 1434 and 1444 are current limiting resistors that limit base currents of the transistors 433 and 443.

Next, an operation of the relay 1430 and a protection circuit (a hardware circuit not including the CPU 420) using the relay 1440 will be described. When a level of any one of the signals Th1 to Th7 exceeds a predetermined value set in a comparison portion 1431, the comparison portion 1431 operates a latch portion 1432, and the latch portion 1432 latches a RLOFF1 signal in a low state. When the RLOFF1 signal becomes the low state, the transistor 1433 is kept in an off state even if the CPU 420 sets the RLON signal to the high state, and thus the relay 1430 can maintain the off state (safe state). Also, the latch portion 1432 sets the RLOFF1 signal as an output of an open state in a non-latched state.

Similarly, when the level of any one of the signals Th1 to Th7 exceeds the predetermined value set in the comparison portion 1441, the comparison portion 1441 operates the latch portion 1442, and the latch portion 1442 latches a RLOFF2 signal in a low state. When the RLOFF2 signal becomes the low state, the transistor 1443 is kept in the off state even if the CPU 420 sets the RLON signal to the high state, and thus the relay 1440 can maintain the off state (safe state). The latch portion 1442 sets the RLOFF2 signal as an output of an open state in a non-latched state. The predetermined value set inside the comparison portion 1431 and the predetermined value set inside the comparison portion 1441 of the present embodiment are both values corresponding to 300° C.

Next, temperature control of the heater 1100 will be described. During the fixing process, each of the heating blocks HB11 to HB17 is controlled to maintain the temperature sensed by the thermistors at the set temperature (control target temperature). Specifically, the electric power supplied to the heating block HB14 is controlled by controlling driving of the triac 1414 to maintain the detected temperature of the thermistor T4 at the set temperature. In this way, each thermistor is used when control for maintaining each heating block at a constant temperature is performed.

In the configuration of the present embodiment, a film surface temperature required to fix the toner image on general paper is 180° C., and a desired film temperature can be obtained by controlling the heater at 240° C. in a paper passing portion (a region through which the recording material passes). If a temperature difference occurs in a longitudinal direction of the film, the film is biased in a direction of higher temperature, which leads to a conveyance failure of the recording material or damage to the film, and thus the non-paper passing portion is similarly controlled such that the film surface temperature becomes 180° C. In the non-paper passing portion, heat is not transferred to the recording material while a member thereof accumulates heat, and thus the film surface can be adjusted to 180° C. by controlling the heater temperature to 200° C.

The CPU 420 changes the target temperature of each heating block on the basis of size information of the recording material. For example, when printing is performed on Letter paper, all of HB1 to HB7 correspond to the paper passing portion, and thus all heating blocks are controlled to be at the target temperature of 240° C. On the other hand, when printing is performed on B5 size paper, HB1, HB2, HB6, and HB7 are non-paper passing portions, and HB3 to HB5 are paper passing portions, and thus the HB1, HB2, HB6, and HB7 are controlled to be at a target temperature of 200° C., and the HB3 to HB5 are controlled to be at a target temperature of 240° C. The CPU 420 performs PI control on the basis of the target temperature of each heating block and the detected temperature of each thermistor and calculates electric power required to set each heating block to the target temperature. The required electric power differs depending on at what temperature the heater is maintained and whether or not the recording material is actually passing through the heating blocks. When an energization amount (an energization duty) for outputting the maximum electric power of the heater of the present embodiment is set as 100%, Table 1 shows how many % of the energization duty is necessary to be able to maintain the heater at a predetermined temperature. That is, the energization duty is a ratio of actually supplied electric power to the maximum electric power capable of being supplied to the heating block when the electric power supplied to the heating block is controlled to maintain the temperature sensed by the temperature sensing element at a predetermined control target temperature.

TABLE 1

| | Maintained at 240° C. | Maintained at 200° C. |
|---|---|---|
| Recording material passes through heating block | 60% | 50% |
| Recording material does not pass through heating block | 40% | 30% |

The energization duty required to maintain the heater temperature at 240° C. is 60% when the recording material actually passes through the heating block. However, since heat is not transferred to the recording material when the recording material does not pass therethrough, it is possible to maintain 240° C. with a 40% energization duty smaller than the above.

The energization duty required to maintain the heater temperature at 200° C. has the same relationship, and the heater temperature can be maintained at an energization duty of 50% for the heating block through which the recording material passes and 30% for the heating block through which the recording material does not pass.

Figure 5:
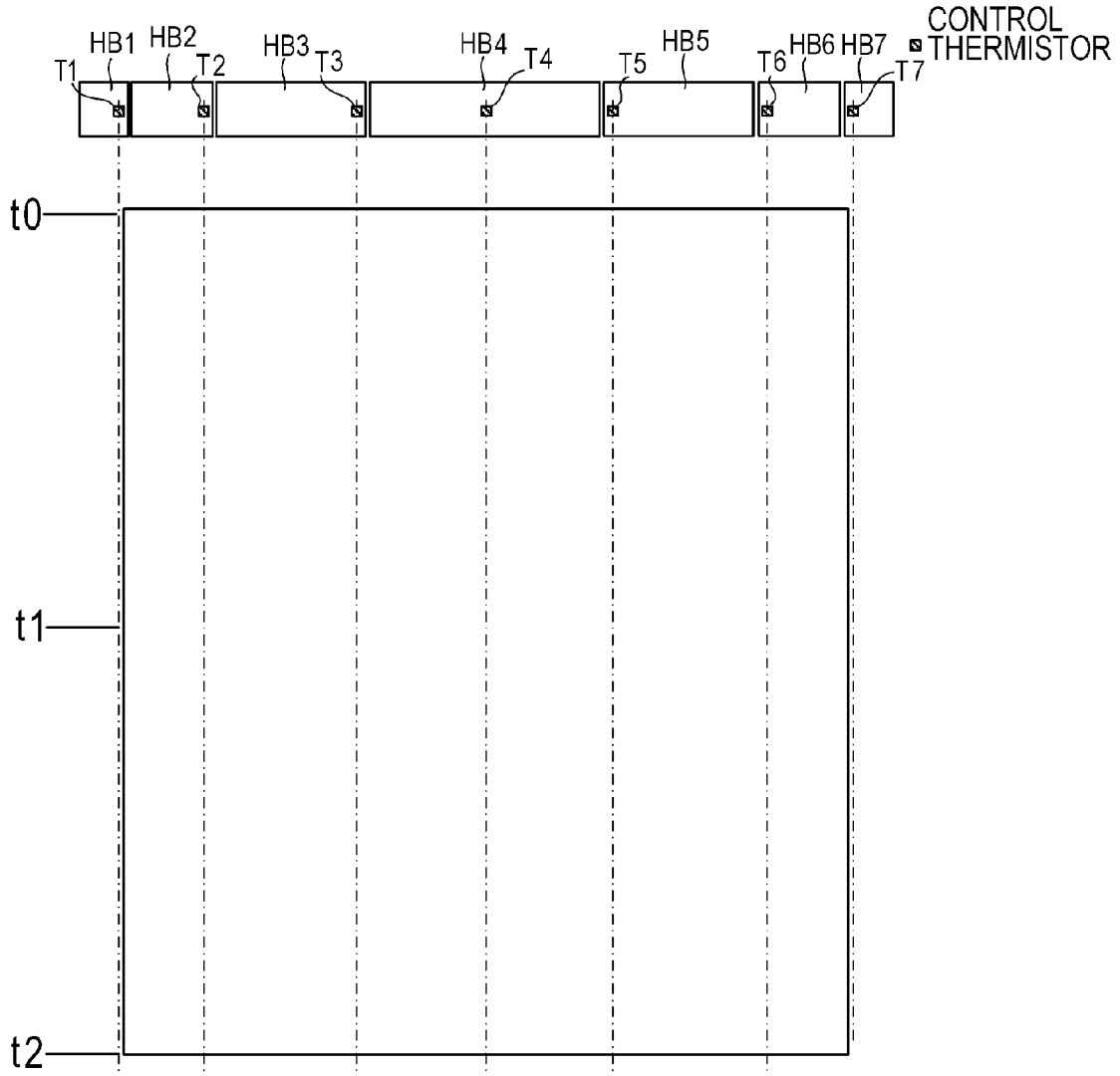
FIG. 5 shows a positional relationship between heating blocks and thermistors at the time of regular conveyance of a recording material according to a first embodiment.

FIG. 5 shows a positional relationship between each heating block and thermistor when an A4 size recording material P is conveyed in a regular state. As shown in the figure, when the A4 size recording material P passes through end heating blocks HB1 and HB7 disposed near left and right end portions of the recording material P, the thermistors T1 and T7 for controlling the energization duty of the end heating blocks HB1 and HB7 are positioned in the non-paper passing portion. In the present embodiment, the thermistor T1 and the thermistor T7 are disposed at positions 2 mm outside from the left and right end portions of the A4 size. In addition, with respect to the fixing nip portion N of the fixing device 200, a timing at which a leading end portion of the recording material P conveyed in the regular state arrives is set as t0, a timing at which a middle portion of the recording material P arrives is set as t1, and a timing at which a trailing end portion of the recording material P arrives is set as t2.

Figure 6:
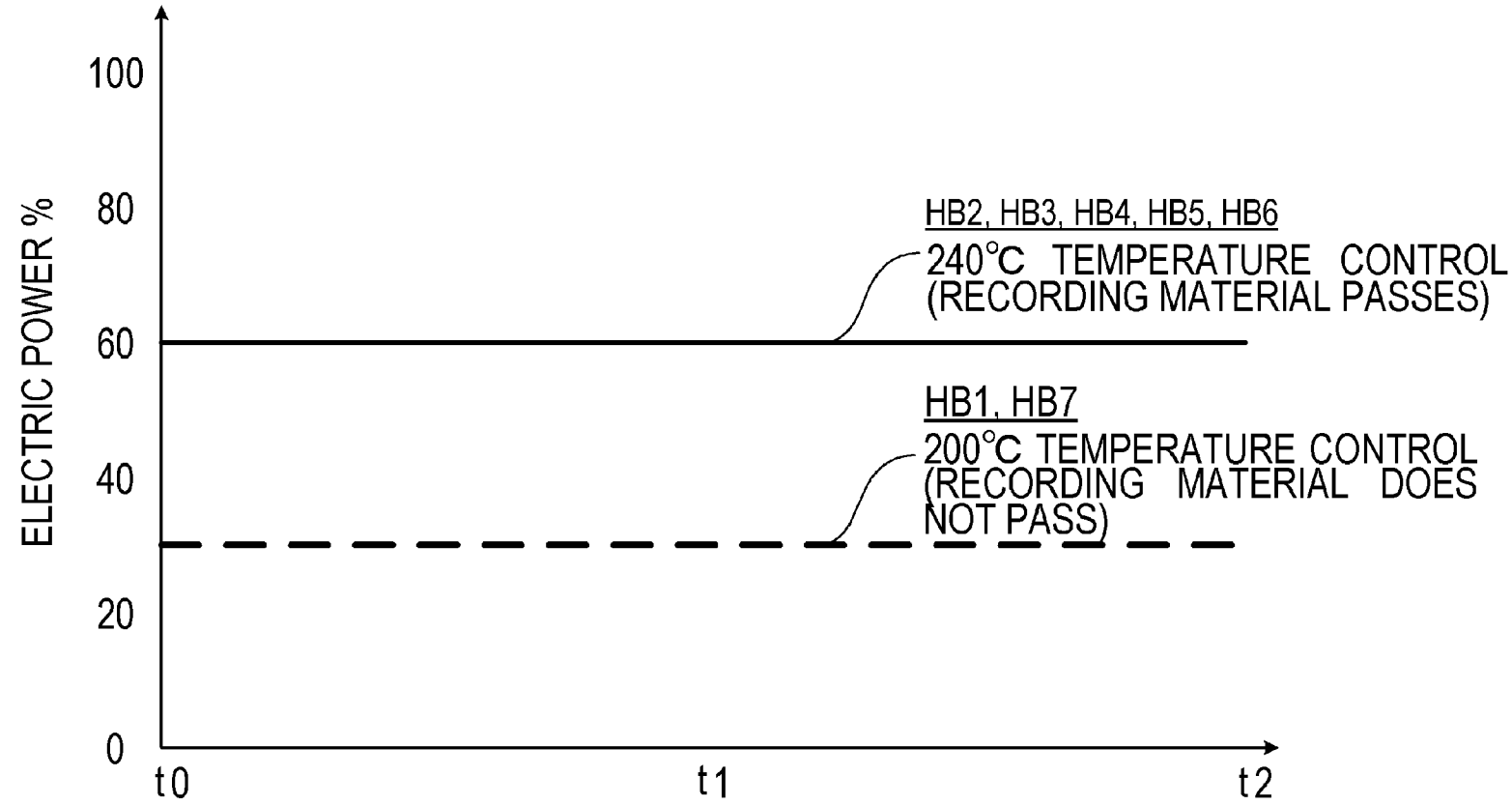
FIG. 6 shows an energization duty of each heating block at the time of regular conveyance of the recording material according to the first embodiment.

FIG. 6 shows the energization duty of each heating block when the recording material P of A4 size is conveyed in the regular state. In the heating blocks HB2 to HB6, which are paper passing portion heating blocks for heating the paper passing portion inside the end heating blocks HB1 and HB7, the fixing film can be maintained at a desired temperature by adjusting each of control thermistors T2 to T6 to the temperature of 240° C. The energizing duty at that time is set to be 60% shown in Table 1. In addition, in the end heating blocks HB1 and HB7 which are non-paper passing portions, the fixing film can be maintained at a desired temperature by adjusting each of the control thermistors to the temperature of 200° C., and the energization duty at that time is set to be 30% shown in Table 1. Each energization duty is kept substantially constant over the timing t0 to t1 to t2 during which the recording material passes through the fixing device at a regular paper passing position.

Figure 7:
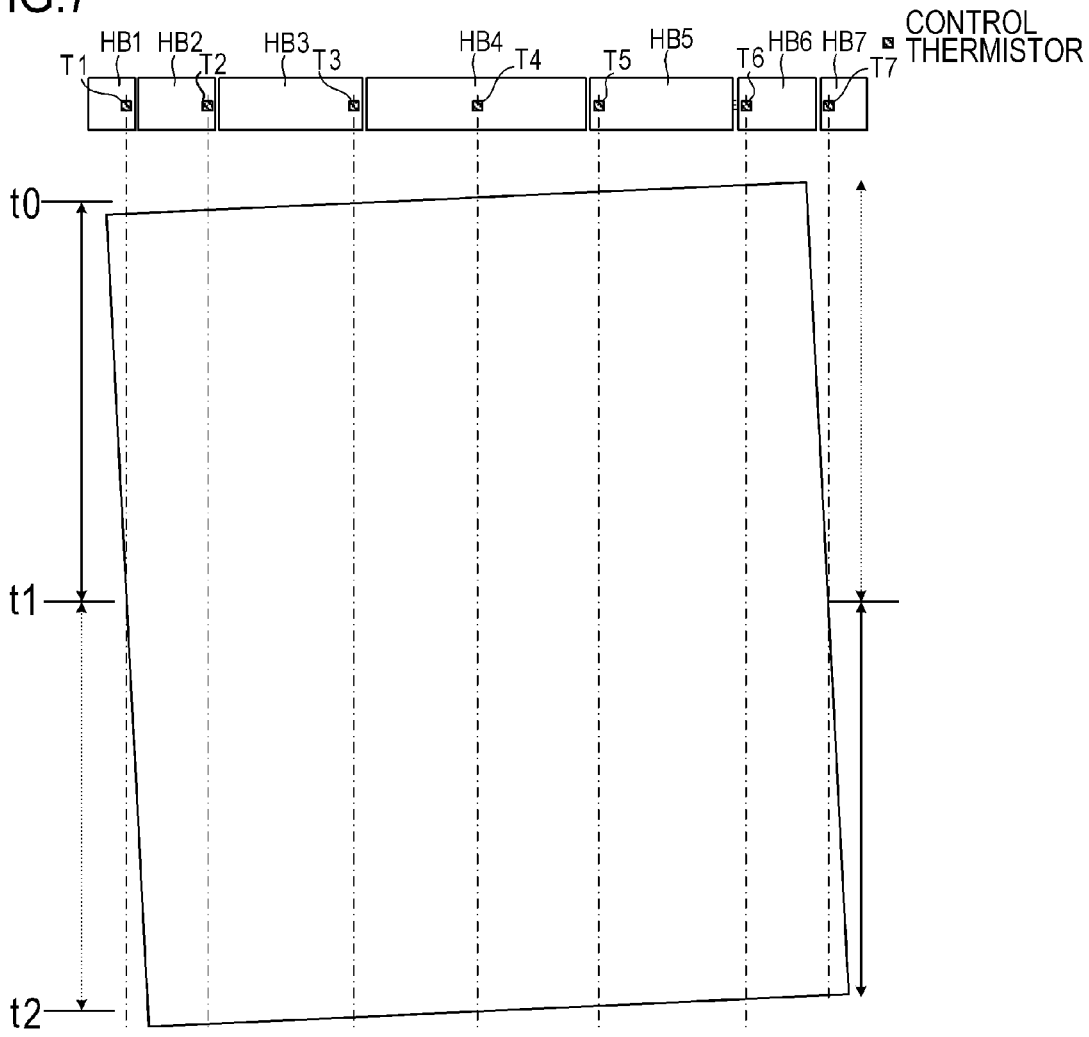
FIG. 7 shows a positional relationship between the heating blocks and the thermistors at the time of skew conveyance of the recording material according to the first embodiment.

Next, as shown in FIG. 7, a case in which the recording material P passes in a state in which the longitudinal and lateral directions of the recording material P are obliquely inclined with respect to the conveying direction (hereinafter, referred to as "skew") will be described as an example. This is an example in which a leading end side of the recording material P of A4 size is skewed to the left with respect to the regular paper passing position. According to FIG. 7, the leading end side or trailing end side of the recording material P passes through positions of the control thermistors T1 and T7 of the end heating blocks HB1 and HB7, which are the non-paper passing portions at the regular paper passing position. Specifically, at the position of the control thermistor T1, the leading end side of the recording material P becomes the paper passing portion, and the non-paper passing portion extends from the middle to the trailing side thereof. In addition, at the position of the control thermistor T7, the leading end side of the recording material P becomes the non-paper passing portion, and the paper passing portion extends from the middle to the trailing side thereof. Further, since heat is transferred to the recording material P while the recording material P passes through the positions of the control thermistors T1 and T7, the energization duties thereof for maintaining 200° C. increase as compared with the case in which they are the non-paper passing portions.

Figure 8:
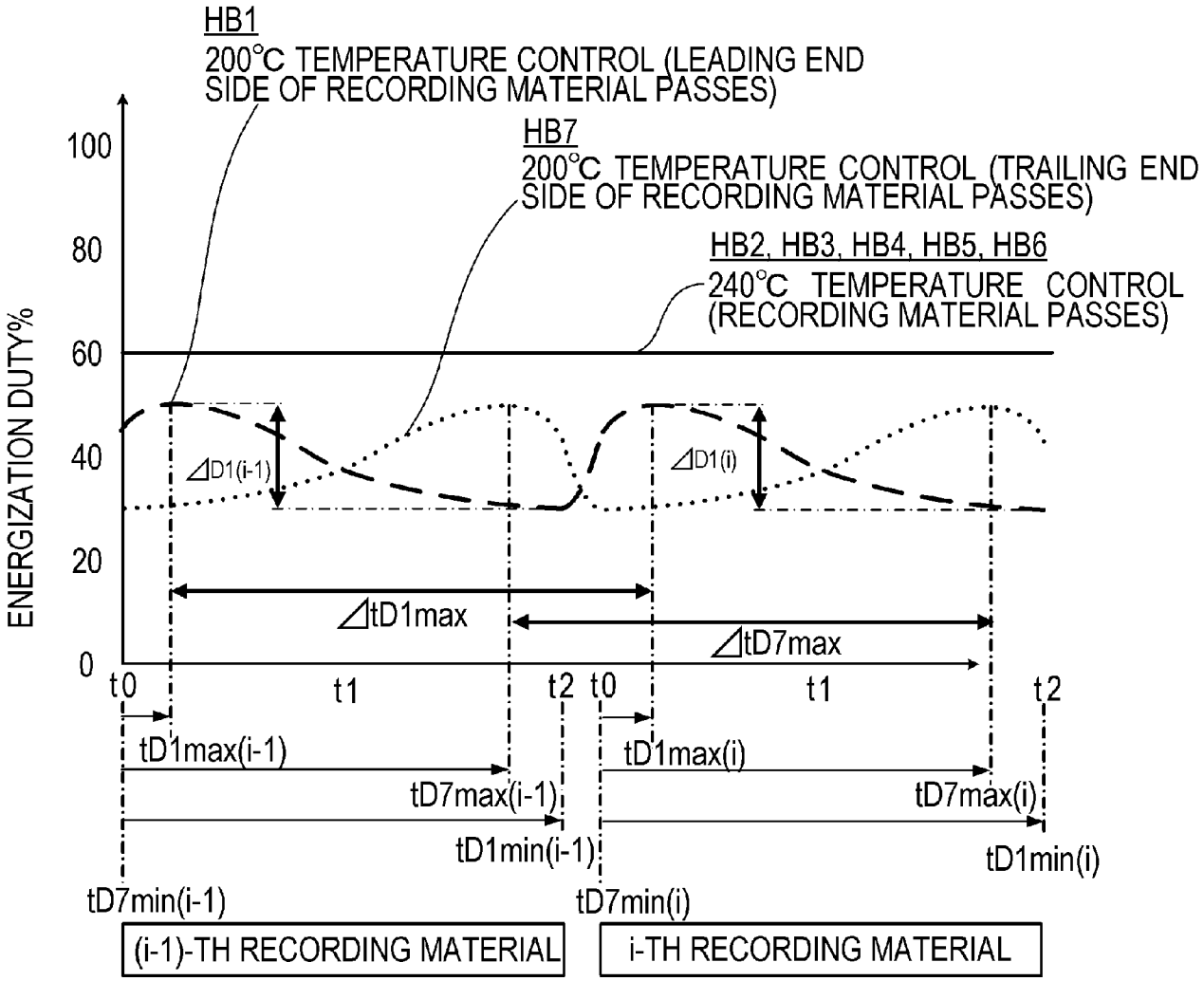
FIG. 8 shows an energization duty of each heating block at the time of skew conveyance of the recording material according to the first embodiment.

FIG. 8 shows the energization duty of each heating block when conveyed in the skewed state as shown in FIG. 7. In the heating blocks HB2 to HB6, which are the paper passing portions, the energization duty of 60% is maintained as in FIG. 6. In the heating block HB1, the leading end side of the recording material P serves as the paper passing portion as described above. Therefore, the energization duty for keeping the control thermistor T1 at 200° C. is 50% at the maximum on the t0 side which is the leading end side of the recording material P, and the non-paper passing portion extends from t1 to t2, and thus the energization duty approaches 30%. In the heating block HB7, the opposite is the case, and the energization duty increases from 30% on the t0 side to the t1 and t2 sides and reaches the energization duty of 50% at the maximum.

That is, in the configuration of the present embodiment, when the A4 size recording material P is conveyed in the skewed state, the energization duties of the heating block HB1 and the heating block HB7 change relatively greatly when the recording material P passes therethrough. It is possible to detect (determine) the skewing of the recording material by detecting the change in the energization duties.

Figure 9:
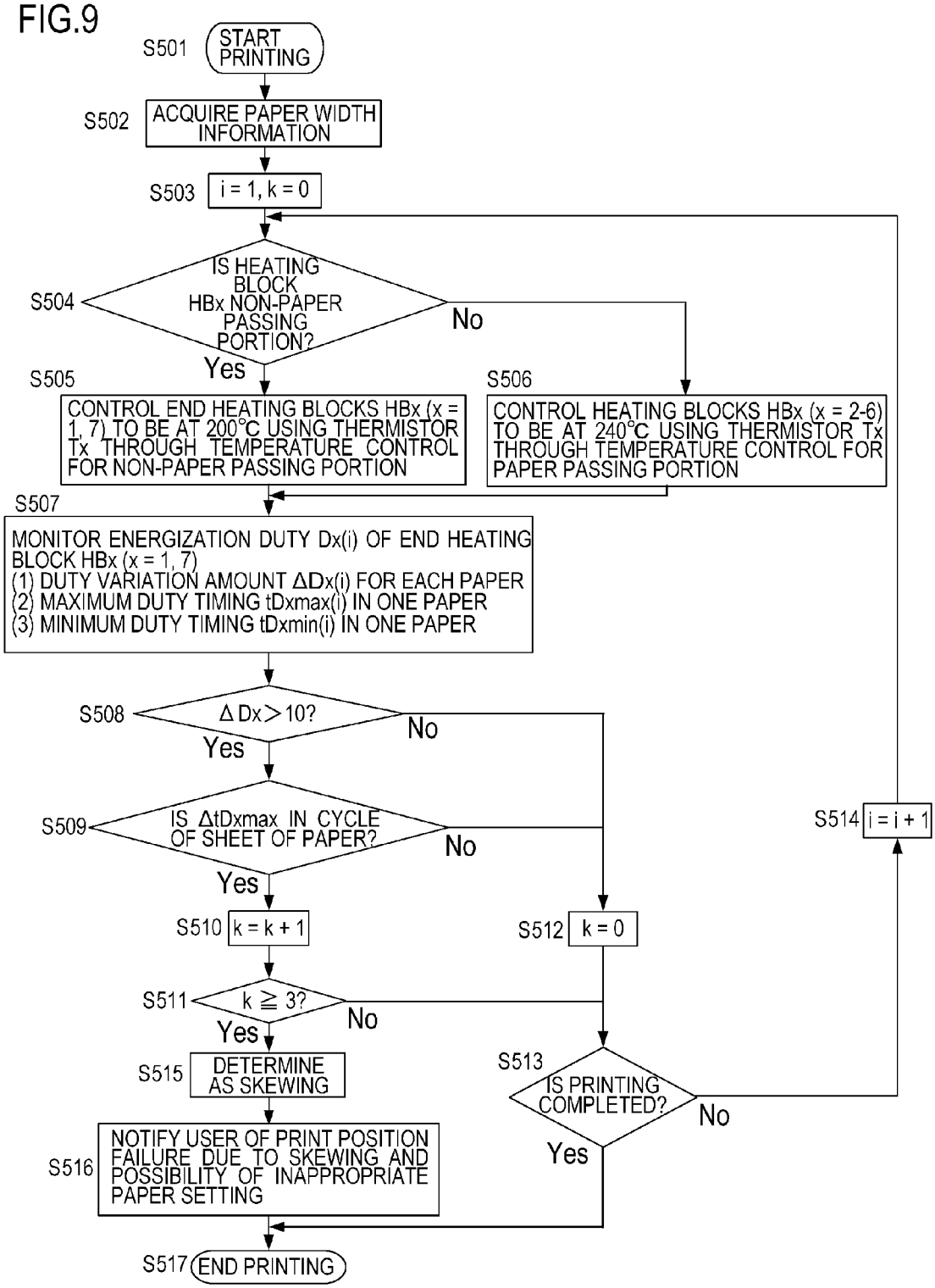
FIG. 9 is a control flowchart according to the first embodiment.

FIG. 9 shows a control flowchart according to the present embodiment. Hereinafter, a method of detecting the skewing according to the present embodiment will be described below with reference to the flowchart.

When printing is started (S501), the image forming device 100 acquires width information of the recording material P (S502), and resets the number i of print jobs and a skew counter k (S503). It is determined whether or not each heating block HBx (x=1 to 7) corresponds to the non-paper passing portion in accordance with the acquired width information of the recording material (S504). When the heating block HBx is the non-paper passing portion, it is discriminated as an end heating block and controlled by the thermistor Tx to be at the non-paper passing portion temperature of 200° C. (S505), and when the paper passing portion, it is controlled by the thermistor Tx to be at the paper passing portion temperature of 240° C. (S506). In the present embodiment, when the A4 size recording material P passes, the heating block HB1 and the heating block HB7 are determined to be the end heating blocks and controlled by the thermistors T1 and T7 to be at the non-paper passing portion temperature of 200° C.

In the heating block HBx that is determined to be the end heating block (x=1 and 7 in the present embodiment), monitoring of the energization duty Dx(i) for maintaining the non-paper passing portion temperature of 200° C. is started (S507). Specifically, various kinds of information indicating a variation state of the energization duty is acquired and stored during a period when an i-th recording material P passes through the fixing device 200 (fixing nip portion thereof) at the time of continuous paper conveyance (from the timing t0 at which the leading end of the recording material passes to the timing t2 at which the trailing end of the recording material passes in FIG. 5). That is, a timing tDxmax(i) at which the energization duty becomes maximum based on the timing t0, a timing tDxmin(i) at which the energization duty becomes minimum, and a difference ΔDx (i) between the maximum value and the minimum value of the energization duty are stored (see FIG. 8).

In the present embodiment, when ΔDx does not exceed 10 as a predetermined variation amount in S508 (when the maximum duty does not exceed 40% with respect to the energization duty of 30% in a regular conveyance state), it is determined that the conveyance state is regular, and the process proceeds to monitoring of the next recording material (S512 to S514). When ΔDx exceeds 10 in S508, it is determined that the recording material P may be skewed, and in the next step S509, it is determined whether tDxmax is repeated in a cycle of a sheet (for each sheet of the recording material when a plurality of recording materials are continuously heated). For example, when the difference ΔtDxmax between tDxmax (i−1) and tDxmax (i) is about the same as the cycle of a sheet of the recording material, it is determined that the recording material P may be conveyed in a skewed state, and the skew counter k is incremented (S510). If it is not repeated in the cycle of a sheet, the skew counter is reset (S512).

In the present embodiment, when the skew counter k is 3 or more in S511, it is determined that the recording material P is repeatedly conveyed in the skewed state (S515). On the basis of this determination, in S516, a user is informed (notified) of a possibility that a print position on the recording material P is skewed and a possibility that setting of paper in the paper feed cassette 11 is inappropriate. Although the method of notifying the user is not particularly limited, for example, as the notification portion, the control portion 113 may display a warning display on the display portion provided on the operation panel 130. In addition to this, an alert (notification sound) may be emitted.

As described above, the energization duty at the time of controlling the temperature of the end heating blocks disposed near the left and right end portions of the recording material P is monitored, and it is detected whether or not the variation in the energization duty for each sheet of the recording materials is repeated in the cycle of a sheet of the recording material P. As a result, it is possible to detect that the recording material P is skewed in a relatively short time after it occurs.

Since the control in the present embodiment is performed to monitor the variation of the energization duty of each of the end heating blocks disposed near the left and right end portions, the skewing can be accurately detected without depending on the temperature difference between the left and right thermistors and the temperature sensing accuracy.

Also, although the skew conveyance is determined by detecting a periodic variation of the timing tDxmax at which the energization duty provided to the end heating block becomes maximum in the present embodiment, the determination method is not limited thereto. For example, the same effect can be obtained by detecting a periodic variation of the timing tDxmin at which the energization duty becomes minimum.

Further, although the periodic variation of the energization duty is detected when the end heating block in the non-paper passing portion is controlled to be at the non-paper passing portion temperature different from that of the non-paper passing portion in the present embodiment, the present invention is not limited thereto, the effect of the present invention can be obtained by controlling the temperature similar to the temperature control of the paper passing portion.

Furthermore, although an example of monitoring the energization duty provided to the end heating block has been described in the present embodiment, the same effect can be obtained by monitoring electric power consumption of the end heating block using an electric power detection circuit or the like.

Second Embodiment

In the first embodiment, as shown in Table 1, an example in which the energization duty is a fixed value when controlled on the basis of the temperature control of the paper passing portion or the temperature control of the non-paper passing portion in each of the case in which the heating blocks pass through the recording material and the case in which they do not pass through the recording material has been described. In a second embodiment, an example in which a possibility that the recording material has been skewed can be accurately detected in the case in which the energization duty changes when the temperature control is performed in consideration of warming-up conditions of the image heating device or the like will be described. Also, repeated descriptions of the constituents and the like of the second embodiment common to those of the first embodiment will be omitted. Configurations not described here in the second embodiment are the same as those in the first embodiment.

Figure 10:
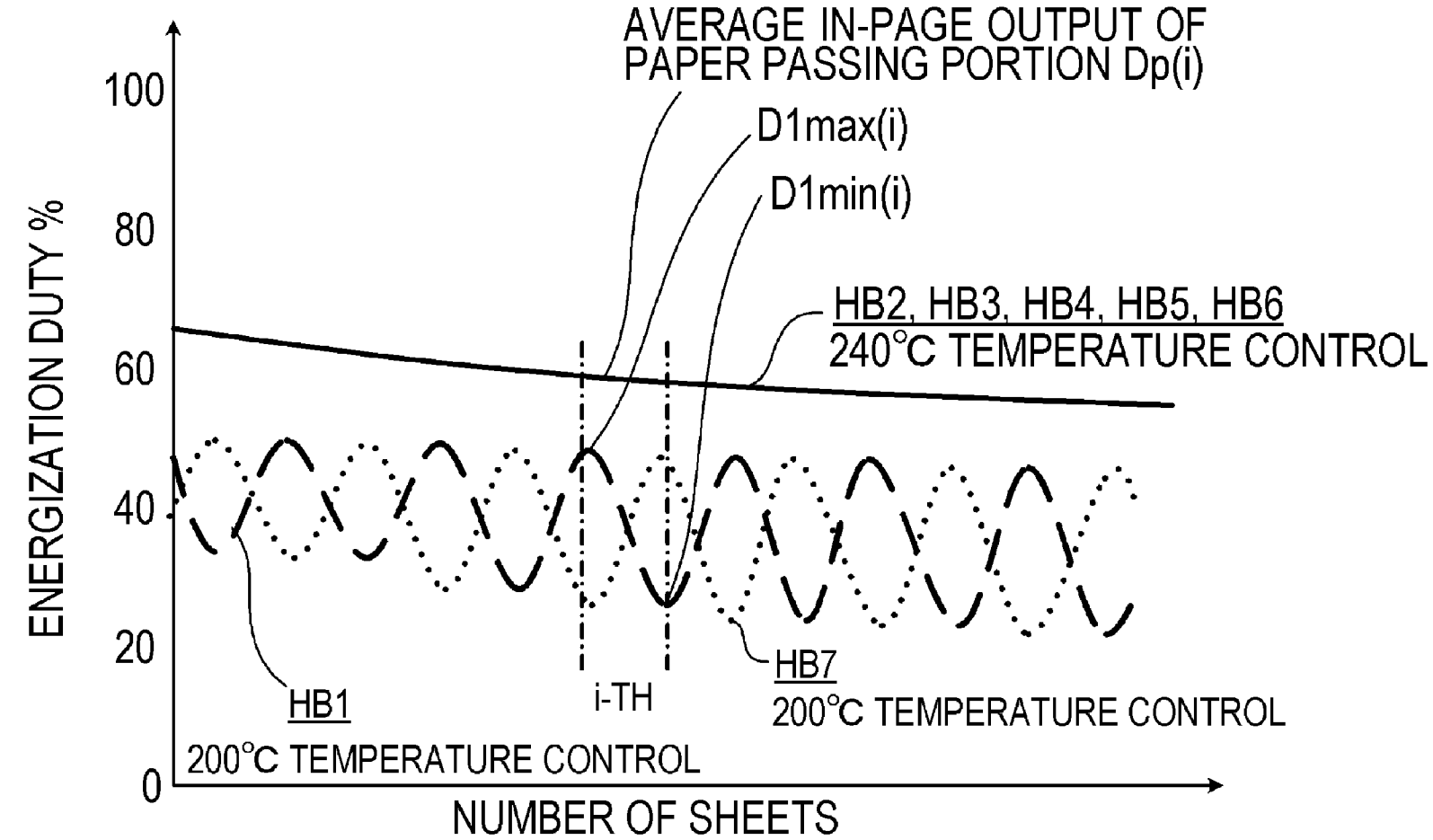
FIG. 10 shows an energization duty of each heating block at the time of continuous skew conveyance of the recording material according to a second embodiment.

FIG. 10 shows changes in the energization duty of each heating block when the recording material P of A4 size is continuously fed with the recording material P skewed in the image forming device 100 of the present embodiment.

In the heating blocks HB2 to HB6 which are paper passing portions, the energization duty gradually decreases with continuous paper feeding while they are controlled at 240° C. as temperature control for the paper passing portions. The fact that the energization duty gradually decreases is because each member of the image heating device accumulates heat as the recording material is continuously fed, and the same temperature control can be maintained with a smaller energization duty.

In the end heating blocks HB7 and HB7 which are non-paper passing portions, the recording material continuously conveyed in a skewed state repeats a state in which the recording material passes through the thermistors T1 and T7 and a state in which the recording material does not pass through the thermistors T1 and T7 for each sheet while they are controlled at 200° C. as temperature control for the non-paper passing portions. Therefore, the energization duty gradually decreases while relatively large periodic variation is repeated. The gradual decrease is due to the fact that each member of the image heating device accumulates heat, like the paper passing portions.

In this way, when the energization duty changes depending on warming-up conditions of the image heating device, it also affects a variation in the energization duty of the non-paper passing portions.

Figure 11:
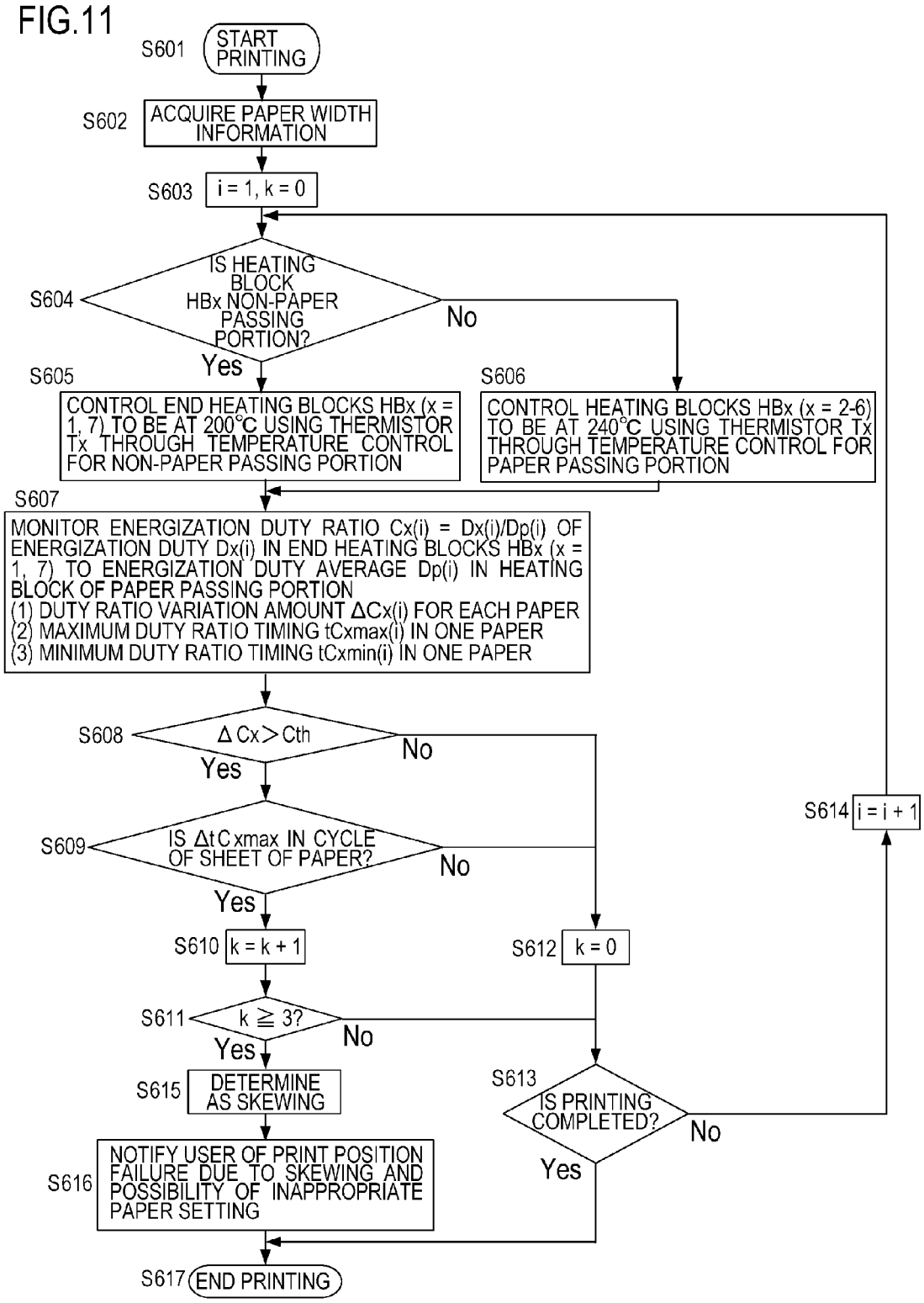
FIG. 11 is a control flowchart according to the second embodiment.

FIG. 11 shows a control flowchart in the present embodiment. The present embodiment is different from the first embodiment in that a ratio Cx of the energization duty Dx of the end heating block corresponding to the non-paper passing portion to the energization duty Dp of the heating block corresponding to the paper passing portion among the heating blocks is monitored.

S601 to S606 are the same as S501 to S506 in the flowchart (FIG. 9) of the first embodiment.

In S607, from an in-page average value Dp(i) of the energization duty of the heating block corresponding to the paper passing portion of an i-th recording material and the energization duty Dx(i) of the end heating block corresponding to the non-paper passing portion, a ratio Cx(i)=Dx(i)/Dp(i) is calculated and monitored. Then, a timing tCmax(i) at which the ratio Cx(i) reaches the maximum duty ratio, a timing tCmin(i) at which it reaches the minimum duty ratio, and a variation ΔCx(i) of the duty ratio are stored.

As described above, by monitoring the ratio of the energization duty of the paper passing portion to the energization duty of the non-paper passing portion at the same timing, the variation amount in accordance with warming-up conditions of the image heating device can be monitored. Therefore, it is possible to accurately detect the possibility that the recording material P is being skewed.

In the present embodiment, it is determined that the recording material is in a regular conveyance state while ΔCx does not exceed a threshold Cth in S608, and the process proceeds to monitor the next recording material (S612, S613, and S614), and when ΔCx exceeds the threshold Cth, it is determined that the recording material P may be skewed. When the variation amount mentioned above is about the same in the case in which the recording material P is skewed with respect the image heating device having different warming-up conditions, the threshold Cth of ΔCx is set to a fixed value, and when the variation amount changes, the threshold is separately set in accordance therewith. Steps after S609 (S609 to S617) are the same as S509 to S517 in the flowchart (FIG. 9) of the first embodiment.

As described above, by performing the control of the present embodiment in the case in which the energization duty when the temperature control is performed changes depending on warming-up conditions of the image heating device, it is possible to accurately detect the possibility that the recording material is being skewed.

Also, although an example in which the ratio Cx of the energization duty Dx of the end heating block corresponding to the non-paper passing portion to the energization duty Dp of the heating block corresponding to the paper passing portion is monitored has been described, the present invention is not limited thereto and, for example, a difference between Dp and Dx may be monitored.

Third Embodiment

In a third embodiment, an example in which a direction and an inclination amount of skewing are detected on the basis of a difference in periodic variation between the end heating blocks for detecting the on left and right sides will be described. Since configurations of the image forming device and the image heating device in the present embodiment are the same as those in the first embodiment, detailed descriptions thereof will be omitted. Configurations not described here in the third embodiment are the same as those in the first embodiment.

Figure 12:
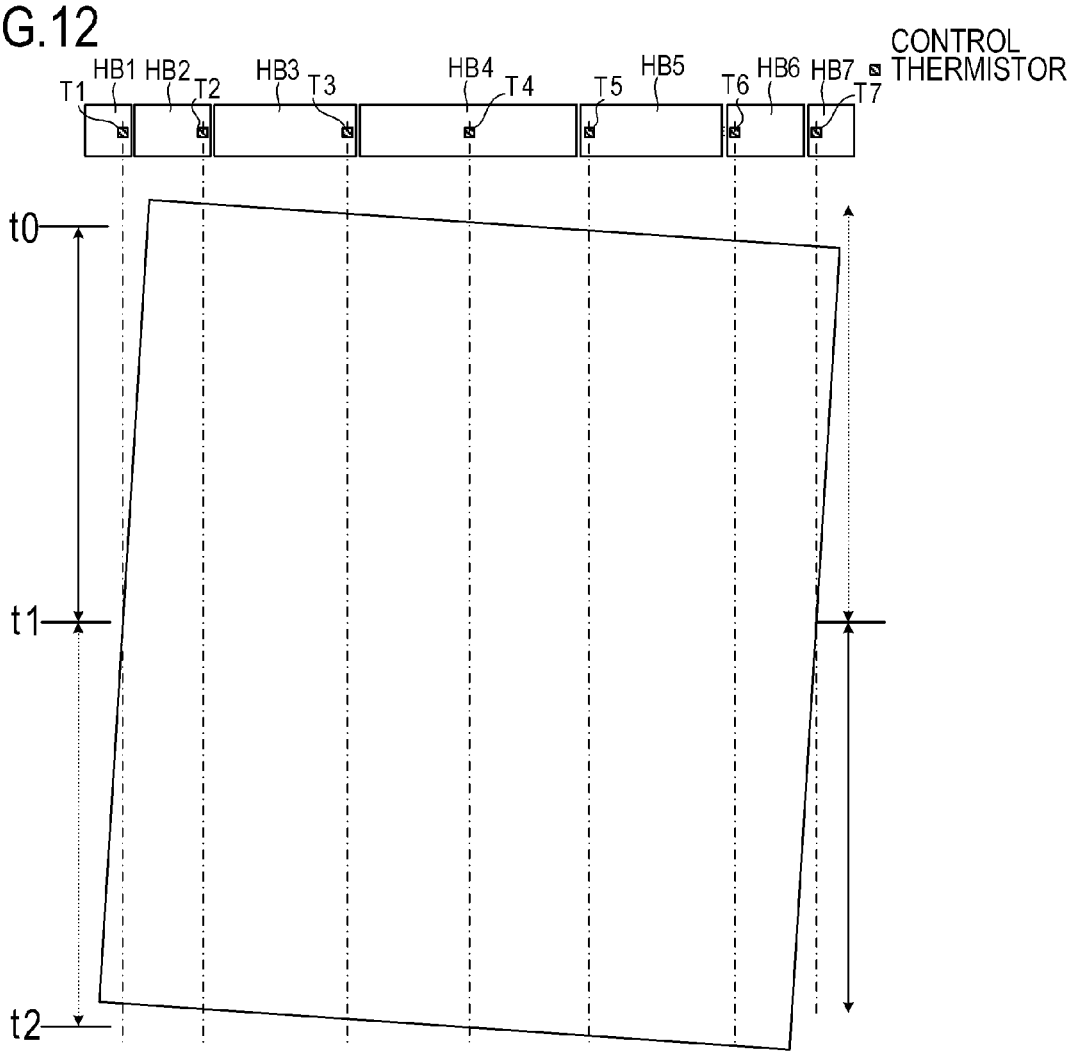
FIG. 12 shows a positional relationship between the heating blocks and the thermistors at the time of skew conveyance of the recording material according to a third embodiment.

FIG. 12 is an example in which the leading end side of the recording material P of A4 size is skewed to a right side, which is opposed to the first embodiment, with respect to the regular paper passing position. According to FIG. 12, at the position of the control thermistor T1, the leading end side of the recording material P serves as the non-paper passing portion, and the paper passing portion extends from the middle to the trailing end side. In addition, at the position of the control thermistor T7, the leading end side of the recording material P serves as the paper passing portion, and the non-paper passing portion extends from the middle to the trailing end side.

Figure 13:
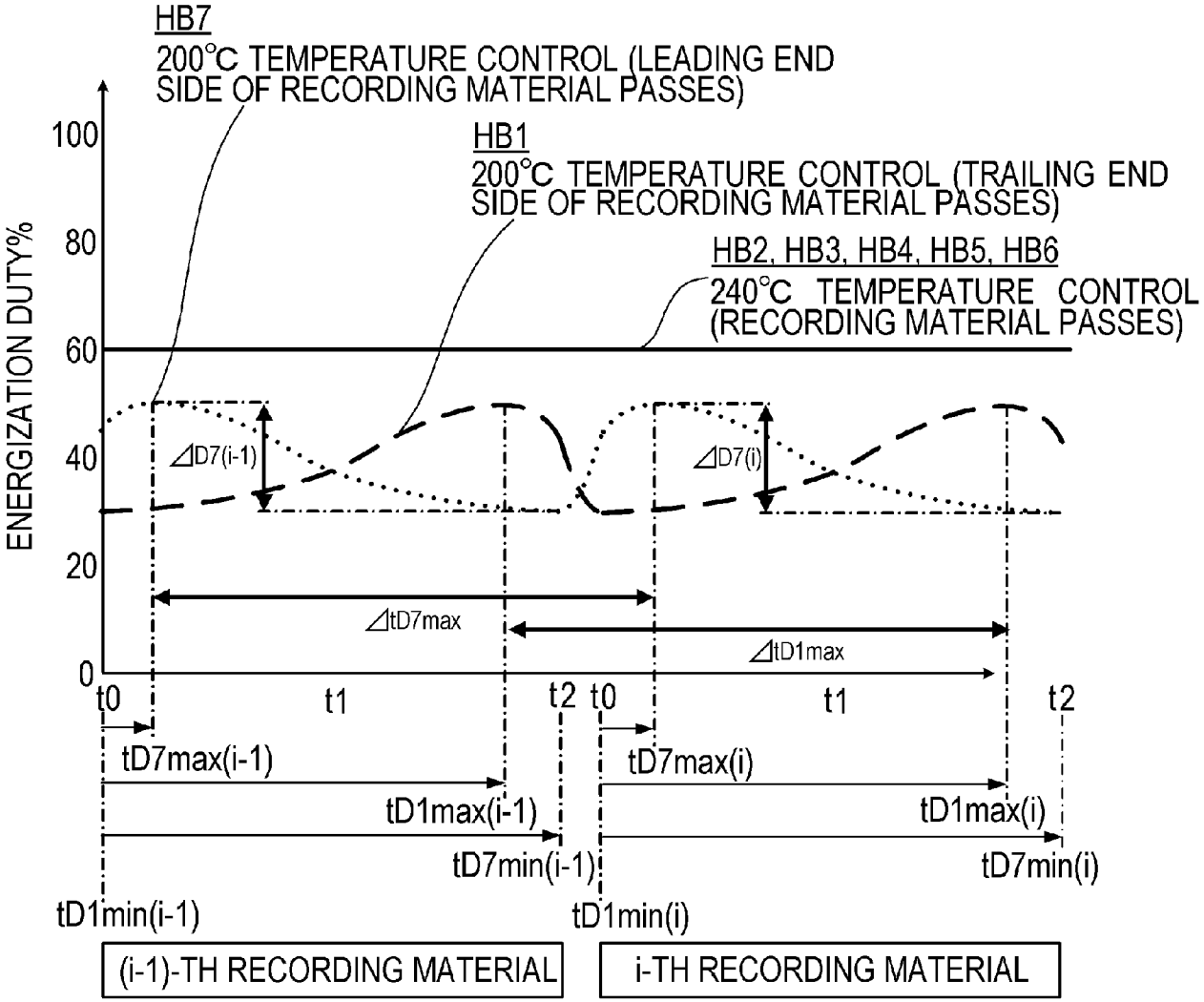
FIG. 13 shows an energization duty of each heating block at the time of skew conveyance of the recording material according to the third embodiment.

FIG. 13 shows changes in the energization duty of each heating block for one recording material in the present embodiment. According to FIG. 13, it can be seen that a variation in the energization duty of the end heating blocks HB1 and HB7 shows a reverse tendency to that in FIG. 8 of the first embodiment. That is, temporal relations between a timing tD1max at which the energization duty of the end heating block HB1 becomes maximum and a timing tD7max at which the energization duty of the end heating block HB7 becomes maximum are compared with each other. On the basis of a difference between these timings, it is possible to detect whether the recording material P is inclined leftward or rightward with respect to the conveying direction. Further, in the present embodiment, as the inclination of the skewing increases to the right, the timing tD1max becomes smaller (starts earlier than the timing t0), and the timing tD7max becomes larger (starts later than the timing t0). The inclination amount of the skewing can also be predicted on the basis of magnitudes of these timings.

Figure 14:
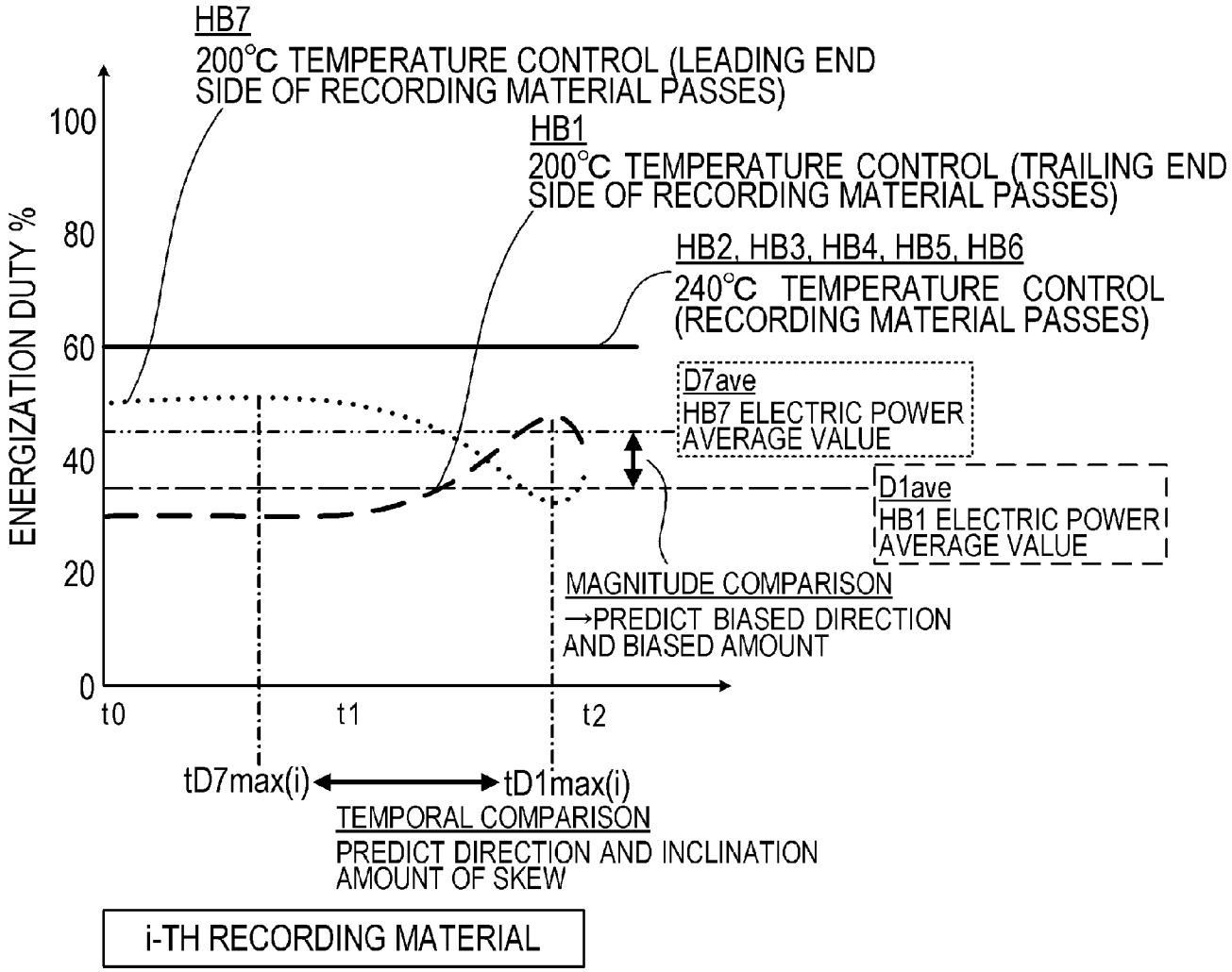
FIG. 14 shows an energization duty of each heating block at the time of biased skew conveyance of the recording material according to the third embodiment.

Further, FIG. 14 shows the energization duty of each heating block when the recording material P of the present embodiment is skewed rightward and is biased to the right side (the end heating block HB7 side). When the recording material P is biased toward the end heating block HB7 in the skewed state, a time during which the recording material P passes through the end heating block HB7 increases, and thus an average energization duty D7ave of the end heating block HB7 increases. On the contrary, since a time during which the recording material P passes through the end heating block HB1 decreases, an average energization duty D1ave of the end heating block HB1 decreases. In this way, by comparing magnitudes of the average energization duty D1ave of one end heating block HB1 and the average energization duty D7ave of the other end heating block HB7 for one recording material, a biased direction and a biased amount thereof from the skewed state can be predicted.

Figure 15:
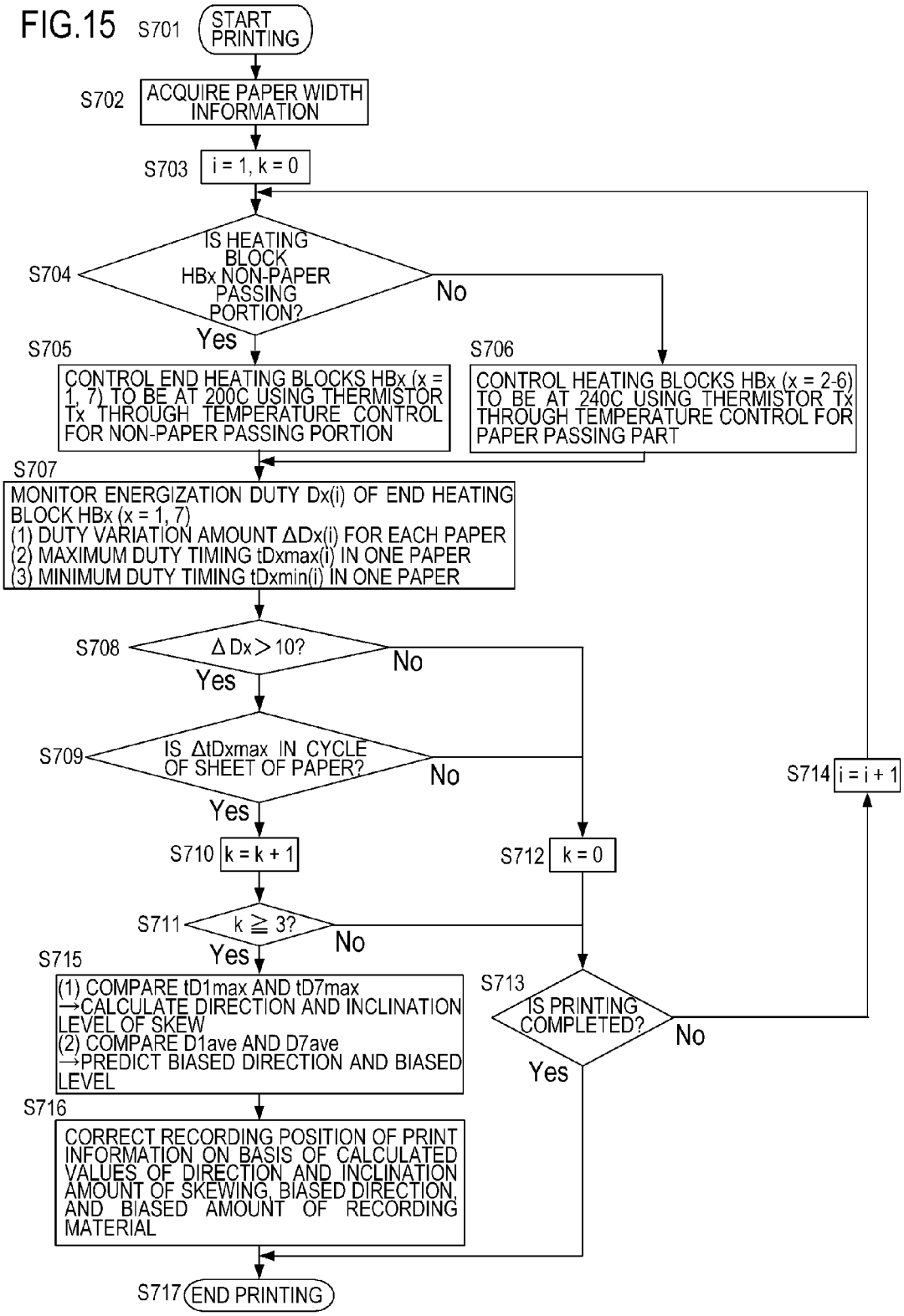
FIG. 15 is a control flowchart according to the third embodiment.

FIG. 15 shows a control flowchart of the present embodiment. S701 to S714 are the same as S501 to S514 in the flowchart (FIG. 9) of the first embodiment.

In S715, (1) the maximum timings tD1max and tD7max of the energization duties of the end heating blocks HB1 and HB7 which are the non-paper passing portions are compared with each other to calculate the direction and the inclination amount of the skewing. Specifically, magnitudes of the maximum timing tD1max and the maximum timing tD7max are compared with each other, and it is determined that the recording material P is inclined toward the heating block corresponding to a smaller one (in the present embodiment, since tD7max is smaller, it is determined that the recording material P is inclined toward the HB7 side). In addition, the inclination amount is calculated from the magnitude of each of the maximum timing tD1max and the maximum timing tD7max.

Further, in S715, (2) the average energization duty D1ave and the average energization duty D7ave are compared with each other to calculate the biased direction and the biased amount from the skewed state. Specifically, magnitudes of the average energization duty D1ave and the average energization duty D7ave are compared with each other, and it is determined that the recording material P is biased toward the heating block side corresponding to a larger one. Also, the biased amount is calculated from a proportion in the magnitudes of the average energization duty D1ave and the average energization duty D7ave.

In S716, a recording position of print information (an image forming position on the recording material) is corrected on the basis of the skew direction, the inclination amount, the biased direction, and the biased amount of the recording material P in S715, thereby preventing a problem of print position misalignment due to skewing.

As described above, by comparing differences in periodic variations between the end heating blocks for detecting the skew on the left and right sides, the direction and the inclination amount of the skew, and the biased direction and the biased amount from the skewed state can be detected. As a result, since it is possible to deal with problems besides notifying the user of the skew, usability can be improved from the viewpoint of not imposing an extra burden on the user.

Also, although the biased direction and the biased amount from the skewed state are predicted by comparing the average energization duties of the left and right end heating blocks for each recording material in the present embodiment, the prediction method is not limited thereto. For example, the same prediction can be performed by monitoring a difference in energization duty between the left and right end heating blocks.

Fourth Embodiment

In a fourth embodiment, an example in which skewing of the recording material is comprehensively and accurately detected on the basis of various information in the image forming device will be described. The configurations of the image forming device and the fixing device in the present embodiment are the same as those in the first to third embodiments, and detailed descriptions thereof will be omitted. Configurations not described here in the fourth embodiment are the same as those in the first to third embodiments.

Figure 16:
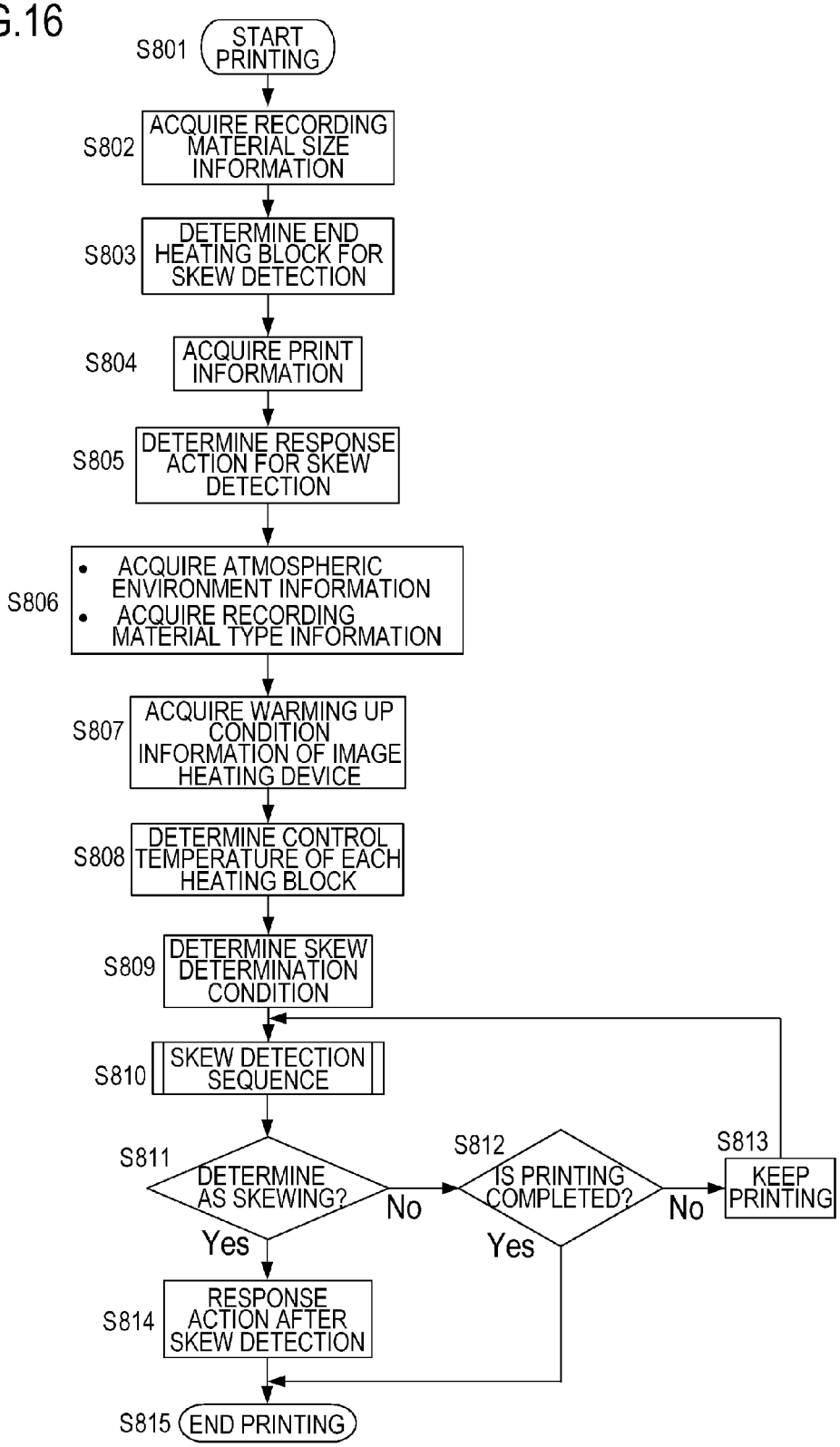
FIG. 16 is a control flowchart according to a fourth embodiment.

FIG. 16 shows a control flowchart of the present embodiment. When printing is started (S801), the image forming device 100 acquires recording material size information (S802). Next, a heating block for skew detection is determined on the basis of the recording material size information (S803). For example, in the case of a paper size such as LETTER size (216 mm×279 mm) or A4 size (210 mm×297 mm), the heating block HB1 and the heating block HB7 are selected as the end heating blocks for skew detection. Also, in the case of B5 size (182 mm×258 mm), the heating block HB2 and the heating block HB6 are selected as the end heating blocks for skew detection, and in the case of A6 size (105 mm×148 mm), the heating block HB3 and the heating block HB5 are selected as the end heating blocks for skew detection.

In S804, the image forming device 100 acquires print information to be recorded. Specifically, a print range on the recording material P to be originally recorded, density information of the recorded contents, and the like are acquired.

In S805, a response action when the skew is detected is determined on the basis of the recording material size information and the print information acquired as mentioned above. For example, when the LETTER size or the A4 size is skewed, left and right end portions of the recording material may be rubbed against a frame body of a conveyance path in the image forming device to induce a conveyance failure such as jam or paper wrinkle. Therefore, the user is notified of that fact and the possibility that setting of paper (a holding state of the recording material in the paper feed cassette or the like) may be inappropriate is notified. Alternatively, in the case in which the print range is wider than a size of the recording material, the user is notified of the possibility that the print range will run off the recording material P due to skewing, or a response action of correcting the printing position through the control as shown in the third embodiment is determined.

In S806, atmospheric environment information is acquired by a temperature and humidity sensor or the like, and information about a thickness and a type of the recording material is acquired by a media sensor or the like. A fixing temperature of the recording material P is determined on the basis of the information on the atmospheric environment and the type of the recording material in addition to the print information. Further, in S807, information such as the temperature of the fixing device is acquired, and in S808, the control temperature of each heating block is determined.

In S809, conditions for determining the skewing are determined on the basis of the atmospheric environment information, recording material type information, and control temperature information of each heating block described above. For example, if the ambient temperature is high or the recording material is thin, the variation amount of the energization duty of the end heating block for skew detection is small even in the same skew state, and thus it is desirable to reduce the threshold for skew detection.

In S810, the presence or absence of skewing is determined on the basis of a skew detection sequence described in the first to third embodiments (S811), and normal printing is continued until it is determined that skewing has occurred (S812 and S813). If it is determined that there is skewing in S811, a response action determined in S805 is performed in S814.

As described above, by determining skew determination conditions in accordance with various information in the image forming device and determining the response action when skewing is detected, it is possible to detect the skewing of the recording material with high accuracy and to provide an image forming device with high usability.

Although the first to fourth embodiments have been described so far, various modifications can be made within the technical idea of the present invention.

Further, the respective embodiments described above can be combined with each other within allowable ranges.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-098502, filed on May 27, 2019, which is hereby incorporated by reference herein in its entirety.

What is claimed is:

1. An image forming device comprising:

an image forming portion which forms an image on a recording material;

an image heating portion which includes a heater including a plurality of heating blocks divided in a direction orthogonal to a conveying direction of the recording material and heats the image formed on the recording material;

a plurality of temperature sensing elements, each of which senses a temperature of each of the heating blocks; and a control portion which controls electric power supplied to each of the heating blocks on the basis of the temperature sensed by each of the plurality of temperature sensing elements;

wherein the control portion determines whether or not the recording material is in a skewed state in which the recording material is conveyed in an obliquely inclined state with respect to the conveying direction on the basis of a variation of an energization duty supplied to end heating blocks for heating end portions of the recording material among the plurality of the heating blocks, and wherein the energization duty is a ratio of actually supplied electric power to a maximum electric power capable of being supplied to a heating block when the electric power supplied to the heating block is controlled so that the temperature sensed by the temperature sensing element is maintained at a predetermined control target temperature.

2. An image forming device comprising:

an image forming portion which forms an image on a recording material;

an image heating portion which includes a heater including a plurality of heating blocks divided in a direction orthogonal to a conveying direction of the recording material and heats the image formed on the recording material;

a plurality of temperature sensing elements each of which senses a temperature of each of the heating blocks; and a control portion which controls electric power supplied to each of the heating blocks on the basis of the temperature sensed by each of the plurality of the temperature sensing elements;

wherein the control portion determines whether or not the recording material is in a skewed state in which the recording material is conveyed in an obliquely inclined state with respect to the conveying direction on the basis of a variation of the electric power supplied to end heating blocks for heating end portions of the recording material among the plurality of the heating blocks, wherein the image heating portion continuously heats images formed on a plurality of recording materials, and wherein the control portion determines that the recording material is in the skewed state in a case in which a timing at which actually supplied electric power is maximum or minimum with respect to a maximum electric power capable of being supplied to a heating block when the electric power supplied to the heating block is controlled to maintain the temperature sensed by the temperature sensing element at a predetermined control target temperature is repeated continuously for a predetermined number of the recording materials in the end heating blocks.

3. The image forming device according to claim 1, wherein the control portion determines whether or not the recording material is in the skewed state, on the basis of a variation amount of the energization duty of the end heating blocks with respect to the energization duty of a paper passing portion heating block disposed inward from the end heating blocks among the plurality of the heating blocks.

4. The image forming device according to claim 3, wherein the image heating portion continuously heats images formed on a plurality of recording materials, and wherein the control portion determines that the recording material is in the skewed state in a case in which a ratio of the energization duty of the end heating blocks to the energization duty of the paper passing portion heating block varies to exceed a predetermined threshold continuously for a predetermined number of the recording materials.

5. The image forming device according to claim 3, wherein the image heating portion continuously heats images formed on a plurality of recording materials, and wherein the control portion determines that the recording material is in the skewed state in a case in which a difference between the energization duty of the paper passing portion heating block and the energization duty of the end heating blocks exceeds a predetermined threshold continuously for a predetermined number of the recording materials.

6. The image forming device according to claim 1, further comprising a notification portion which notifies a user that the skewed state has been detected when the control portion determines that the recording material is in the skewed state.

7. The image forming device according to claim 6, wherein information of which the user is notified by the notification portion includes at least one of a possibility that a position at which the image is formed on the recording material deviates from a regular position, a possibility that a conveyance failure of the recording material occurs, and a possibility that the recording material is not properly held in a paper feeding portion that feeds the recording material.

8. The image forming device according to claim 1, wherein the control portion acquires a direction in which the recording material is skewed or an inclination amount of the recording material with respect to a regular conveying direction by temporally comparing, between a first end heating block of the end heating blocks and a second end heating block of the end heating blocks, a timing at which actually supplied electric power is maximum or minimum with respect to a maximum electric power capable of being supplied to a heating block when the electric power supplied to the heating block is controlled to maintain the temperature sensed by the temperature sensing element at a predetermined control target temperature.

9. The image forming device according to claim 1, wherein the control portion acquires a biased direction or a biased amount of the recording material in a direction orthogonal to the conveying direction by comparing, in terms of magnitude and between a first end heating block of the end heating blocks and a second end heating block of the end heating blocks, an average value of actually supplied electric power with respect to a maximum electric power capable of being supplied to a heating block when the electric power supplied to the heating block is controlled to maintain the temperature sensed by the temperature sensing element at a predetermined control target temperature.

10. The image forming device according to claim 1, wherein the control portion acquires a biased direction or a biased amount of the recording material in a direction orthogonal to the conveying direction on the basis of a difference, between a first end heating block of the end heating blocks and a second end heating block of the end heating blocks, of actually supplied electric power with respect to a maximum electric power capable of being supplied to a heating block when the electric power supplied to the heating block is controlled to maintain the temperature sensed by the temperature sensing element at a predetermined control target temperature.

11. The image forming device according to claim 9, wherein the image forming portion corrects an image forming position on the recording material on the basis of the biased direction or the biased amount.

12. The image forming device according to claim 1, further comprising an acquisition portion which acquires size information of the recording material, wherein the control portion determines the end heating blocks on the basis of the size information acquired by the acquisition portion.

13. The image forming device according to claim 12, wherein the control portion determines a response action after determining that the recording material is in the skewed state on the basis of the size information and the information of the image formed on the recording material.

14. The image forming device according to claim 1, wherein the control portion determines a control target temperature when supplying electric power to the heating blocks and a condition for determining whether or not the recording material is in the skewed state on the basis of any one of atmosphere environment information of the image forming device, recording material type information, information on the image formed on the recording material, and information on warming up condition of the image heating portion.

15. The image forming device according to claim 1, further comprising:

a heating unit that includes the heater;

a tubular film having an inner surface coming into contact with the heating unit; and a pressure member which comes into contact with an outer surface of the film and forms a nip portion for conveying the recording material between the outer surface and the pressure member in cooperation with the heating unit, wherein the heater includes a substrate and a heating resistor provided on the substrate and divided in the direction orthogonal to the conveying direction of the recording material.

* * * * *